US007397439B2

(12) United States Patent
Kanno et al.

(10) Patent No.: US 7,397,439 B2
(45) Date of Patent: Jul. 8, 2008

(54) SLOT ANTENNA

(75) Inventors: Hiroshi Kanno, Osaka (JP); Kazuyuki Sakiyama, Osaka (JP); Ushio Sangawa, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/723,786

(22) Filed: Mar. 22, 2007

(65) Prior Publication Data

US 2007/0164918 A1 Jul. 19, 2007

Related U.S. Application Data

(63) Continuation of application No. PCT/JP2006/321541, filed on Oct. 27, 2006.

(30) Foreign Application Priority Data

Nov. 10, 2005 (JP) ..... 2005-325674

(51) Int. Cl.
*H01Q 13/10* (2006.01)

(52) U.S. Cl. ..... 343/767

(58) Field of Classification Search ..... 343/700 MS, 343/767, 770, 771, 862, 864
See application file for complete search history.

(56) References Cited

U.S. PATENT DOCUMENTS 5,036,335 A * 7/1991 Jairam ..... 343/767

(Continued)

FOREIGN PATENT DOCUMENTS

JP 31-000464 1/1956

(Continued)

OTHER PUBLICATIONS

L. Zhu et al. "A Novel Broadband Microstrip-Fed Wide Slot Antenna With Double Rejection Zeros", IEEE Antennas and Wireless Propagation Letters, 2003, pp. 194-196, vol. 2.

(Continued)

*Primary Examiner*—Michael C Wimer
(74) *Attorney, Agent, or Firm*—McDermott Will & Emery LLP

(57) ABSTRACT

A slot antenna according to the present invention includes: a ground conductor 12 provided on a rear face side of a dielectric substrate 101, the ground conductor having a finite area; a slot 14 which recesses into the ground conductor 12, beginning from an open-end point on a side edge of the ground conductor 12; and a feed line 261 for supplying a high-frequency signal to the slot 14, the feed line 261 intersecting the slot 14. At a first point near the slot, the feed line 261 branches into a group of branch lines including at least two branch lines, such that at least two branch lines in the group of branch lines are connected to each other at a second point near the slot to form at least one loop line 209. A maximum value of a loop length of each loop line 209 is prescribed to be less than 1× effective wavelength at an upper limit frequency of an operating band of the slot antenna. In the group of branch lines, any branch line that does not constitute a part of the loop line 209 but terminates with a leading open-end point has a branch length which is less than a ¼ effective wavelength at the upper limit frequency of the operating band.

3 Claims, 26 Drawing Sheets

U.S. PATENT DOCUMENTS 5,717,410 A * 2/1998 Ohmine et al. ..... 343/771
2003/0222824 A1 12/2003 Louzir et al.

FOREIGN PATENT DOCUMENTS

JP 31-464 A 1/1956
JP 11-163625 A 6/1999
JP 2003-142937 A 5/2003
JP 2003-234615 A 8/2003
JP 2004-23507 A 1/2004
JP 2004-336328 A 11/2004

OTHER PUBLICATIONS

Yamakawa, K., et al., "A Basic Study of Hole-Slot Cavity Antenna using Loop Feeding", 1991 Spring National Convention Record, 1991, pp. 2-136, B-136 Part 2, The Institute of Electronics, Information and Communication Engineers.
Imada, et al., "A Discussion of Downsizing of a Slot Antenna with a Loop Feeding Activity", 1999 Joint Convention Record, 1989, p. 158, The Hokkaido Chapters of the Institutes of Electrical and Information Engineers.

* cited by examiner

SLOT ANTENNA

This is a continuation of International Application No. PCT/JP2006/321541, with an international filing date of Oct. 27, 2006, which claims priority of Japanese Patent Application No. 2005-325674, filed on Nov. 10, 2005, the contents of which are hereby incorporated by reference.

BACKGROUND OF THE INVENTION

1. Field of the Invention

The present invention relates to an antenna with which a digital signal or an analog high-frequency signal, e.g., that of a microwave range or an extremely high frequency range, is transmitted or received.

2. Description of the Related Art

For two reasons, wireless devices are desired which are capable of operating in a much wider band than conventionally. A first reason is the need for supporting short-range wireless communication systems, for which the authorities have given permission to use a wide frequency band. A second reason is the need for a single terminal device that is capable of supporting a plurality of communication systems which use different frequencies.

For example, a frequency band from 3.1 GHz to 10.6 GHz, which has been allocated by the authorities to short-range fast communication systems, corresponds to a bandwidth ratio as wide as 109.5%. As used herein, "a bandwidth ratio" is a bandwidth, normalized by the center frequency f0, of a band. On the other hand, patch antennas (known as a basic antenna structure) have bandwidth ratio characteristics of less than 5%, whereas slot antennas have bandwidth ratio characteristics of less than 10%. With such antennas, it is very difficult cover the entirety of the aforementioned wide frequency band.

In a preliminary version of specifications which are contemplated for the aforementioned communication systems, it is assumed that the authorized frequency band is to be used while being divided into a plurality of portions. One reason thereof is the difficulty to realize an antenna which covers the entirety of an ultrawideband (UWB) with the currently-available technology.

To take for example the frequency bands which are currently used for wireless communications around the world, a bandwidth ratio of about 30% must be realized in order to cover from the 1.8 GHz band to the 2.4 GHz band with the same antenna. In order to cover also the 800 MHz band and the 2 GHz band in addition to the aforementioned band with the same antenna, a bandwidth ratio of about 90% must be realized. Furthermore, in order to cover from the 800 MHz band to the 2.4 GHz band with the same-antenna, a bandwidth ratio of 100% or must be realized. Thus, as the number of systems to be supported by the same terminal device increases, and as the frequency band to be covered becomes wider, the need will increase for a wideband antenna, this being a solution for realizing a simple terminal device structure.

The ¼ wavelength slot antenna, whose schematic diagram is shown in FIG. 23, is one of the most basic planar antenna structures. FIG. 23A is an upper schematic see-through view; FIG. 23B is a schematic cross-sectional view taken along line AB; and FIG. 23C is a schematic see-through rear view, as seen through the upper face side.

The illustrated slot antenna has a feed line 261 provided on the upper face of a dielectric substrate 101. A recess 14 is formed which extends in the inward direction from an edge 12*a* of a finite ground conductor 12, which in itself is provided on the rear face. Thus, the recess 14 functions as a slot 14 having an open end 13. The slot 14 is a circuit element which is obtained by removing the conductor completely across the thickness direction in a partial region of the ground conductor 12. The slot 14 resonates near a frequency such that its slot length Ls corresponds to a ¼ effective wavelength.

The feed line 261, which partly opposes the slot 14, excites the slot 14. The feed line 261 is connected to an external circuit via an input terminal 201. Note that, in order to establish input matching, a distance t3 from a leading open-end point 20 of the feed line 261 to the center of the slot 14 is typically set to about a ¼ effective wavelength at the frequency f0.

Japanese Laid-Open Patent Publication No. 2004-336328 discloses a structure for operating a ¼ wavelength slot antenna at a plurality of resonant frequencies. FIG. 24A shows a schematic structural diagram thereof. In FIGS. 24A and 24B, those elements which have their counterparts in the antenna of FIG. 23 are denoted by the same reference numerals as their respective counterparts.

In the slot antenna of FIG. 24A, the ¼ wavelength slot 14 is excited at a feed point 15, whereby a usual antenna operation occurs. The resonant frequency of a slot antenna is usually defined by the loop length of the slot 14. In the illustrated antenna, a capacitor element 16 which is provided between a point 16*a* and a point 16*b* is prescribed so as to allow a signal at any frequency that is higher than the intended resonant frequency of the slot 14 to pass through. This makes it possible to vary the resonator length of the slot 14 depending on frequency. Specifically, at lower frequencies, as shown in FIG. 24B, the resonator length of the slot 14 does not change from its usual value, and therefore is determined by the physical length of the recess structure. At higher frequencies, on the other hand, the antenna operates as if the resonator length of the slot 14 were shorter than the actual, physical resonator length, as shown in FIG. 24C. Japanese Laid-Open Patent Publication No. 2004-336328 describes that, based on the above construction, a single slot structure can attain a multiple resonance operation.

Japanese Laid-Open Patent Publication No. 2004-23507 discloses a structure for allowing a ½ wavelength slot antenna to resonate at a plurality of frequencies. FIG. 25 is a see-through view as seen from the side of a rear face ground conductor. As shown in this figure, in Japanese Laid-Open Patent Publication No. 2004-23507, a plurality of slots 14*a*, 14*b* and 14*c*, which are of sizes respectively satisfying the resonance condition for a plurality of desired frequencies, are provided within the structure of a ground conductor 12. Then, the slots 14*a*, 14*b* and 14*c* are excited at points 51*a*, 51*b* and 51*c*, where a ¼ effective wavelength is obtained for each frequency (beginning from an open-end 20 of a feed line 261), whereby multiple resonance is realized. Note that a pattern which is shown by a solid line in FIG. 26 indicates a conductor pattern on the rear face of the substrate, whereas a pattern shown by a dotted line indicates a conductor pattern on the front face of the substrate.

"A Novel Broadband Microstrip-Fed Wide Slot Antenna With Double Rejection Zeros" IEEE Antennas and Wireless Propagation Letters, vol. 2, 2003, pp. 194 to 196 (hereinafter "Non-Patent Document 1") discloses another method for realizing a wideband operation of a ½ wavelength slot antenna. As mentioned above, one input matching method for a conventional slot antenna has been to excite the slot resonator 14 at a point where a ¼ effective wavelength at the frequency f0 is obtained, beginning from the leading open-end point 20 of the feed line 261. However, in Non-Patent Document 1, as shown in FIG. 26 (which shows an upper schematic see-through view), a region spanning a distance corresponding to a ¼ effective wavelength at the frequency f0, beginning from a leading open-end point 20 of a feed line 261, has a narrower line width so as to form a high-impedance region 263. The transmission line in the high-impedance region 263 has a higher characteristic impedance than the characteristic impedance (50Ω) of the normal transmission line, and is coupled to a slot 14 in an approximate center thereof.

In terms of equivalent circuitry, the newly-introduced high-impedance region 263 functions as a resonator which is different from the slot resonator. According to Non-Patent Document 1, such a construction increases the number of resonators to two, and a multiple resonance operation can be obtained by coupling the two resonators. FIG. 2B of Non-Patent Document 1 shows the frequency dependence of return intensity characteristics obtained under the conditions described in Table 1 below.

TABLE 1

| | |
|---|---|
| dielectric constant of substrate | 2.94 |
| substrate thickness | 0.75 mm |
| slot length (Ls) | 24 mm |
| design frequency | 5 GHz |
| t1 + t2 + Ws | 9.8 mm |
| line width W | 20.5 mm |
| offset distance from feed line 261 to slot center | 9.8 mm to 10.2 mm |

According to Non-Patent Document 1, in the above-described range of offset distance, return intensity characteristics as good as −10 dB or less are obtained with a bandwidth ratio 32% (from near 4.1 GHz to near 5.7 GHz). Such band characteristics are much better than the bandwidth ratio of 9% of a usual slot antenna which is produced under the same substrate conditions, as shown in comparison with measured characteristics that are illustrated in FIG. 4 of Non-Patent Document 1.

The aforementioned conventional slot antenna has a problem in terms of wideband-ness.

Firstly, the operating band of a usual slot antenna, which only has a single resonator structure within its structure, is restricted by the band of its resonance phenomenon. As a result of this, the frequency band in which good return intensity characteristics can be obtained only amounts to a bandwidth ratio of less than about 10%.

Although the antenna of Japanese Laid-Open Patent Publication No. 2004-336328 realizes a wideband operation because of a capacitive reactance element being introduced in the slot, there is a problem in that an additional part such as a chip capacitor is required as the actual capacitive reactance element. There is also a problem in that variations in the characteristics of the newly-introduced additional part may cause the antenna characteristics to vary. Furthermore, according to the example disclosed in Japanese Laid-Open Patent Publication No. 2004-336328, there is also a problem associated with the band characteristics. For example, FIG. 14 of Japanese Laid-Open Patent Publication No. 2004-336328 shows an example indicating a multiple resonance operation at 1.18 GHz and 2.05 GHz, but at each frequency, there is only about several tens of MHz of a band in which the VSWR (Voltage Standing Wave Ratio) is less than two. FIG. 18 of Japanese Laid-Open Patent Publication No. 2004-336328 shows an example where a VSWR of less than three is being obtained in a band from 1.7 GHz to 3.45 GHz, which would correspond to a bandwidth ratio of 66%. However, such a band is still insufficient, and a VSWR of about three cannot be considered as representing good return intensity characteristics.

Thus, according to the disclosure of Japanese Laid-Open Patent Publication No. 2004-336328, it is difficult to provide an antenna which attains low-return input matching characteristics in a ultrawide frequency band that is currently desired.

The method of Japanese Laid-Open Patent Publication No. 2004-23507 will prove extremely difficult in practice. Specifically, since the feed line 261 intersects a number of slots between the input terminal and the leading open-end point, a considerable impedance mismatch is predicted. It is even possible that, in each frequency band where the resonant bands of the respective slots overlap one another, good antenna operation may be hindered by a coupling between the adjoining slots. In the case where the plurality of slots introduced in the structure do not have any overlaps between their resonant bands, impedance matching could be realized in each separate frequency band. However, since each slot has a 10% band in actuality, and a different mode of antenna operation will occur also in each spurious band (e.g., second harmonic and third harmonic), there will only be a very limited frequency band in which the desired return intensity characteristics and radiation characteristics are reconciled. In either case, it will be difficult for this structure to achieve a bandwidth ratio of several tens of % or more.

Also in the example of Non-Patent Document 1, where a plurality of resonators are introduced in the structure in order to improve the band characteristics based on coupling between the resonators, the bandwidth ratio characteristics are only as good as about 35%, which needs further improvement. The upper schematic see-through view of FIG. 26 (which is modeled after FIG. 1 of Non-Patent Document 1) illustrates the slot width Ws to be of a small dimension. However, under the conditions for obtaining the aforementioned wideband characteristics, the slot width Ws will have to be set to 5 mm, which accounts for more than half of the length of ¼ wavelength region, i.e., 9.8 mm. When a desire for downsizing the antenna permits only a limited area for accommodating the slot, it may become necessary to fold up the linear-shaped slot, for example. Thus, a structure which requires a large Ws value in order to obtain wideband characteristics will be difficult to be downsized by nature.

SUMMARY OF THE INVENTION

In order to solve the aforementioned conventional problems, the present invention realizes, in a slot antenna, an operation which is more wideband than conventionally under easily-achievable conditions, thus facilitating obtainment of a wideband communication system, and reconcilability of a plurality of systems in a simple type of terminal device.

A slot antenna of the present invention includes: a dielectric substrate; a ground conductor provided on a rear face side of the dielectric substrate, the ground conductor having a finite area; a slot which recesses into the ground conductor, beginning from an open-end point on a side edge of the ground conductor; and a feed line for supplying a high-frequency signal to the slot, the feed line at least partially intersecting the slot, wherein, at a first point near the slot, the feed line branches into a group of branch lines including at least two branch lines, such that at least two branch lines in the group of branch lines are connected to each other at a second point near the slot to form at least one loop line in the feed line, the second point being different from the first point; a maximum value of a loop length of each loop line is prescribed to be less than 1× effective wavelength at an upper limit frequency of an operating band of the slot antenna; and in the group of branch lines, any branch line that does not constitute a part of the loop line but terminates with a leading open-end point has a branch length which is less than a ¼ effective wavelength at the upper limit frequency of the operating band.

In a preferred embodiment, each loop line intersects an edge of the slot, the slot being excitable at two or more feed points which are at different distances from the open-end point.

In a preferred embodiment, a region of the feed line spanning a distance corresponding to a ¼ effective wavelength at a center frequency of the operating band from the leading open-end point is composed of a transmission line having a characteristic impedance higher than 50Ω; and along the distance corresponding to a ¼ effective wavelength at the center frequency of the operating band from the leading open-end point, the feed line at least partially intersects the slot.

In a preferred embodiment, a sum total of the line widths of the group of branch lines is less than a line width of a transmission line having a characteristic impedance of 50Ω disposed on the substrate.

In a preferred embodiment, a sum total of the line widths of the group of branch lines is less than a line width of a transmission line having a characteristic impedance which is higher than 50Ω.

In a preferred embodiment, a lowest-order resonant frequency of the ground conductor is lower than the operating band of the slot antenna.

In a slot antenna of the present invention, a loop line facilitates obtainment of multiple resonance characteristics, which have been difficult to realize with a conventional slot antenna, and thus a wideband operation is enabled. In a conventional slot antenna which already achieves a multiple resonance operation, too, the structure of the present invention can further realize a drastic expansion of the operating band.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 4A illustrates a loop line structure; FIG. 4B illustrates an open-ended stub line structure; and FIG. 4C also illustrates a loop line structure, where a second path is made extremely short.

FIG. 6A illustrates a traditional transmission line; and FIG. 6B illustrates a branching transmission line.

FIG. 14 is an upper schematic see-through view of Example 1a.

FIG. 15 is a comparison graph showing frequency dependence of the return intensity characteristics of Comparative Example 1 and Example 1a.

FIG. 17 is an upper schematic see-through view of Example 2a.

FIG. 18 is a comparison graph showing frequency dependence of the return intensity characteristics of Comparative Example 2 and Example 2a.

FIG. 22(*a*) is an angle-dependence characteristic diagram for 2.6 GHz; FIG. 22(*b*) is an angle-dependence characteristic diagram for 4 GHz; FIG. 22(*c*) is an angle-dependence characteristic diagram for 6 GHz; and FIG. 22(*d*) is an angle-dependence characteristic diagram for 9 GHz.

FIG. 23A is an upper schematic see-through view; FIG. 23B is a cross-sectional side schematic view; and FIG. 23C is a rear schematic view as seen through the upper face side.

DETAILED DESCRIPTION OF PREFERRED EMBODIMENTS

Hereinafter, with reference to the drawings, embodiments of the slot antenna according to the present invention will be described.

Embodiments

Figure 1:
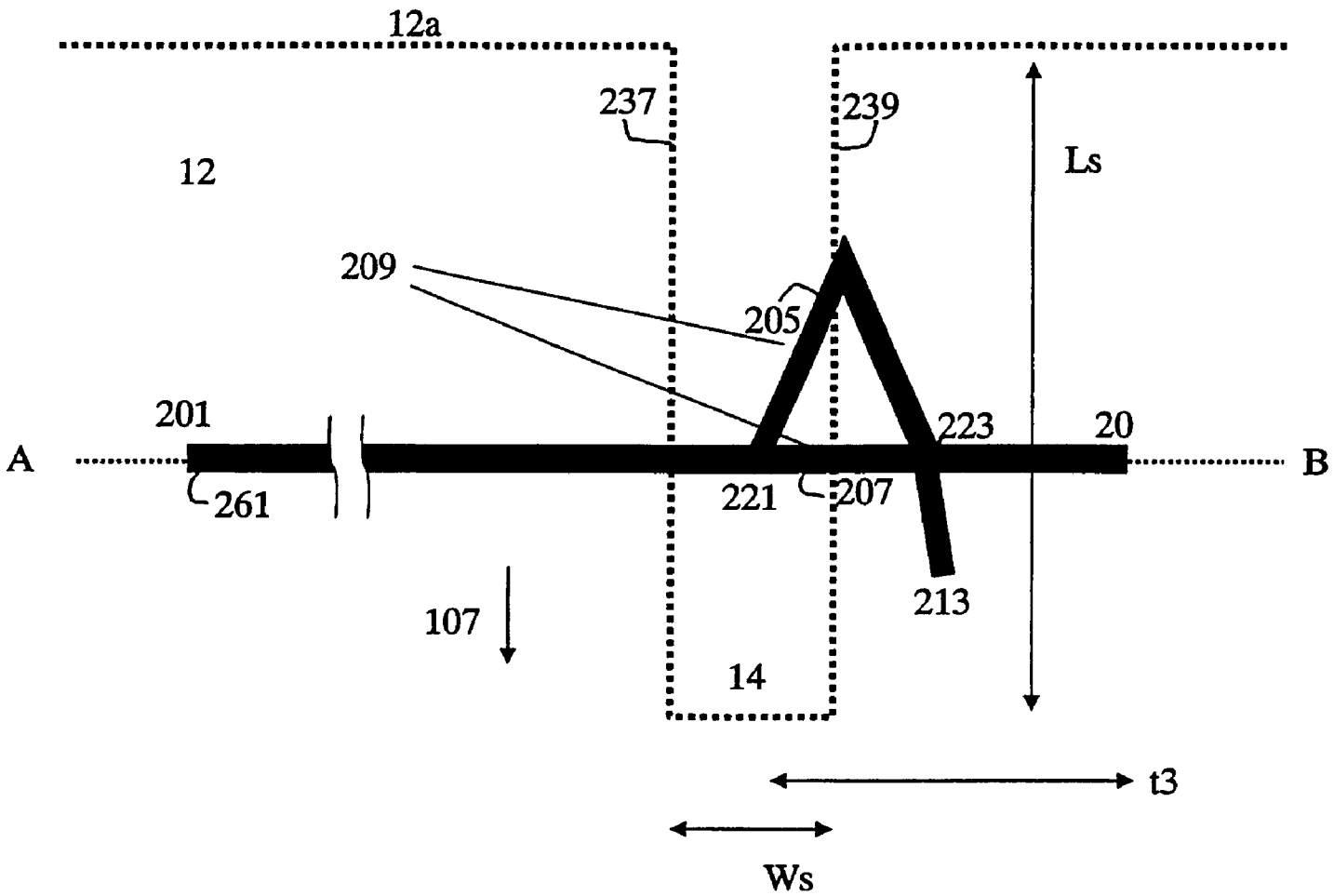
FIG. 1 is an upper schematic see-through view of a slot antenna according to the present invention.

First, FIG. 1 is referred to. FIG. 1 is an upper schematic see-through view showing the structure of a slot antenna according to the present embodiment.

The slot antenna of the present embodiment includes a dielectric substrate 101 (FIG. 2), and a ground conductor 12 provided on the rear face of the dielectric substrate 101, the ground conductor 12 having a finite area. The ground conductor 12 has a slot 14, which is formed by recessing a side edge 12*a* of the ground conductor 12 in an inward direction 107. One end of the slot 14 is opened at the side edge 12*a* of the ground conductor 12, this end functioning as an "open-end point". Assuming that the slot 14 has a slot width Ws which is negligible relative to the slot length Ls, the slot length Ls is prescribed equal to a ¼ effective wavelength near the center frequency f0 of the operating band. When this assumption is not true, a slot length which takes the slot width into consideration (Ls×2+Ws) may be prescribed equal to a ½ effective wavelength at the center frequency f0.

On the front face of the dielectric substrate 101, a feed line 261 which intersects the slot 14 is formed. The feed line 261 is for supplying a high-frequency signal to the slot 14.

Figure 2A:
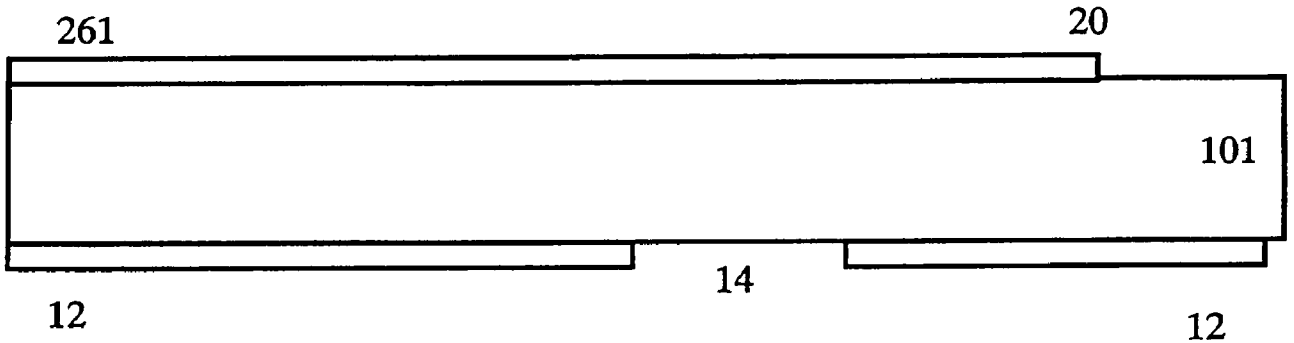
FIG. 2A is a schematic cross-sectional view of the slot antenna according to the present invention shown in FIG. 1.
Figure 2B:
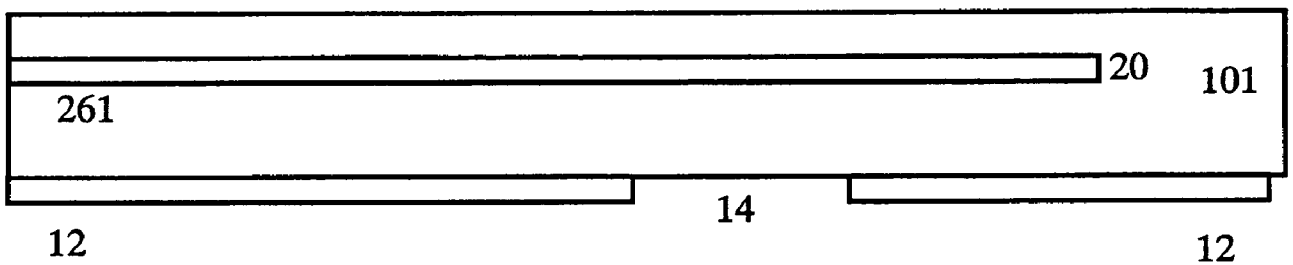
FIG. 2B is a schematic cross-sectional view of another embodiment of the slot antenna according to the present invention.

Next, FIG. 2A is referred to. FIG. 2A is a cross-sectional view taken along line AB in FIG. 1. Although the present embodiment illustrates an example where the feed line 261 is disposed on the frontmost face of the dielectric substrate 101 and the ground conductor 12 is disposed on the rearmost face of the dielectric substrate 101, the slot antenna of the present invention is not limited to those having such a construction. For example, as shown in FIG. 2B, a multilayer substrate or the like may be adopted, such that at least one of the feed line 261 and the ground conductor 12 is disposed in the interior of the dielectric substrate 101.

Figure 2C:
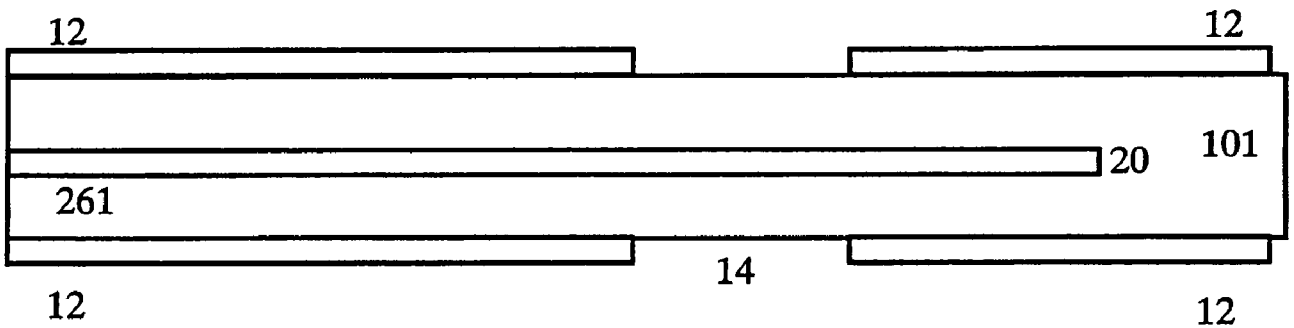
FIG. 2C is a schematic cross-sectional view of still another embodiment of the slot antenna according to the present invention.

Moreover, as shown in FIG. 2C, the number of conductor planes to function as the ground conductor 12 for the feed line 261 is not limited to one in each structure. For example, opposing ground conductors 12 may be provided, with a layer containing the feed line 261 interposed therebetween. In other words, the slot antenna of the present invention can attain similar effects not only when its circuit structure is based on a microstrip line structure, but also when based on a strip line structure.

Note that, in the present specification, a "slot" is defined as an opening which is created by removing a portion of the conductor layer composing the ground conductor 12 completely across the thickness direction. In other words, the "slot" as used in the present specification does not encompass any structure ("non-opening") which is obtained by merely etching a region of the surface of the ground conductor 12 so as to leave a reduced thickness.

The feed line 261 branches into two or more branch lines 205, 207, 213, etc., at a first branching point 223. The first branching point 223 lies in the neighborhood of (i.e., outside) the slot 14. The set of branch lines 205 and 207 again become connected to each other at a second branching point 221, thus forming a loop line 209.

Some of the branch lines 205, 207, 213, etc., may be open stubs which do not constitute parts of the loop line. In the present embodiment, the branch line 213 does not constitute a part of the loop line, and functions as an open stub.

The loop length of the loop line 209 is prescribed to be less than 1× effective wavelength at an upper limit frequency fH of the operating band. Also, the stub length of the open stub 213 in the structure is prescribed to be less than ¼ of the effective wavelength at the upper limit frequency fH.

In FIG. 1, a distance t3 from the leading open-end point 20 of the feed line 261 to the center line of the slot 14 is prescribed equal to a ¼ effective wavelength at the center frequency f0, whereby input matching is established in an operating band containing the center frequency f0. The characteristic impedance of the feed line 261 is preferably prescribed at 50Ω. As used herein, the "center line" of the slot 14 is defined as a line consisting of points each of which is at an equal shortest distance from, among the two edges of the slot 14 extending along the inward direction 107, an edge 237 that is closer to the input terminal 201 of the feed line 261 and an edge 239 that is closer to the leading open-end point 20 of the feed line 261.

Figure 3:
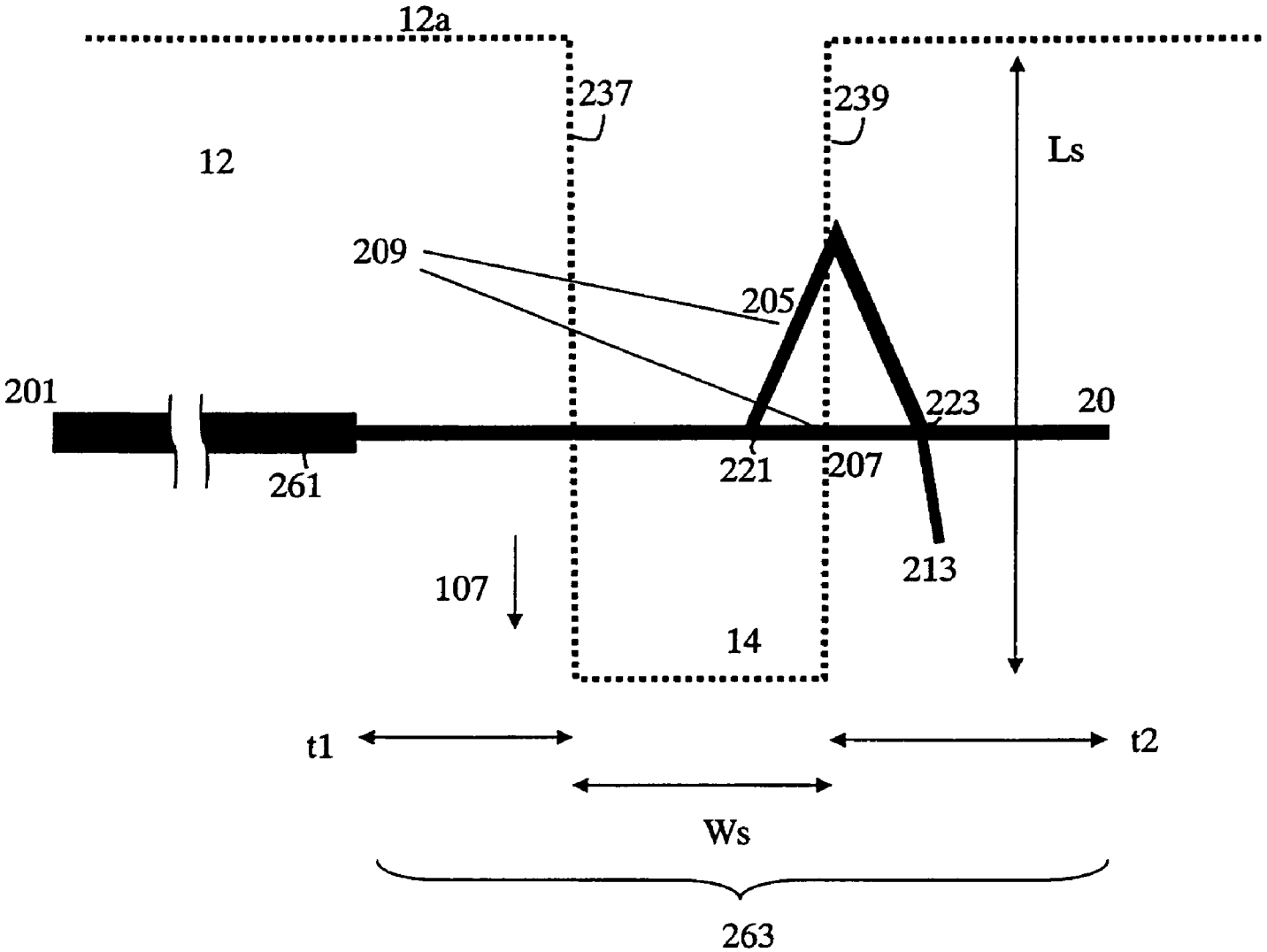
FIG. 3 is an upper schematic see-through view of a slot antenna according to the present invention.

The slot antenna of the present invention may also have a feed line structure as shown in an upper schematic see-through view of FIG. 3. In the example shown in FIG. 3, a portion of the feed line 261 is composed of a transmission line whose characteristic impedance is higher than 50Ω, thus forming a high-impedance region 263. The high-impedance region 263 is a region of the feed line 261 spanning a distance of (t1+Ws+t2) from the leading open-end point 20 toward the input terminal 201.

Preferably, it is ensured that an impedance Zo of a commonly-used external circuit that is connected to the input terminal 201 is equal to a characteristic impedance $Z_{261}$ of the feed line 261. If this value is not 50Ω, the characteristic impedance of the high-impedance region 263 is to be prescribed at an even higher value.

In the example shown in FIG. 3, the length of the high-impedance region 263 is prescribed approximately equal to the ¼ effective wavelength at the center frequency f0. Preferably, the slot width Ws is prescribed approximately equal to a sum of t1 and t2.

The structure shown in FIG. 1 would be effective for obtaining wideband characteristics under conditions which necessitate a narrow slot width Ws. The structure shown in FIG. 3 would be effective for obtaining ultrawideband characteristics under conditions which do not impose any limitations to the slot width Ws.

The loop line 209 of the slot antenna of the present embodiment serves the two functions of: increasing the number of places where the slot resonator is excitable to more than one; and adjusting the electrical length of the input matching circuit, whereby an ultrawideband antenna operation is realized. Hereinafter, the functions of the loop line will be specifically described.

First, high-frequency characteristics in the case where a loop line structure is provided in a traditional high-frequency circuit will be described, assuming that a ground conductor having an infinite area is present on the rear face of a dielectric substrate.

Figures 4A, 4B, 4C:
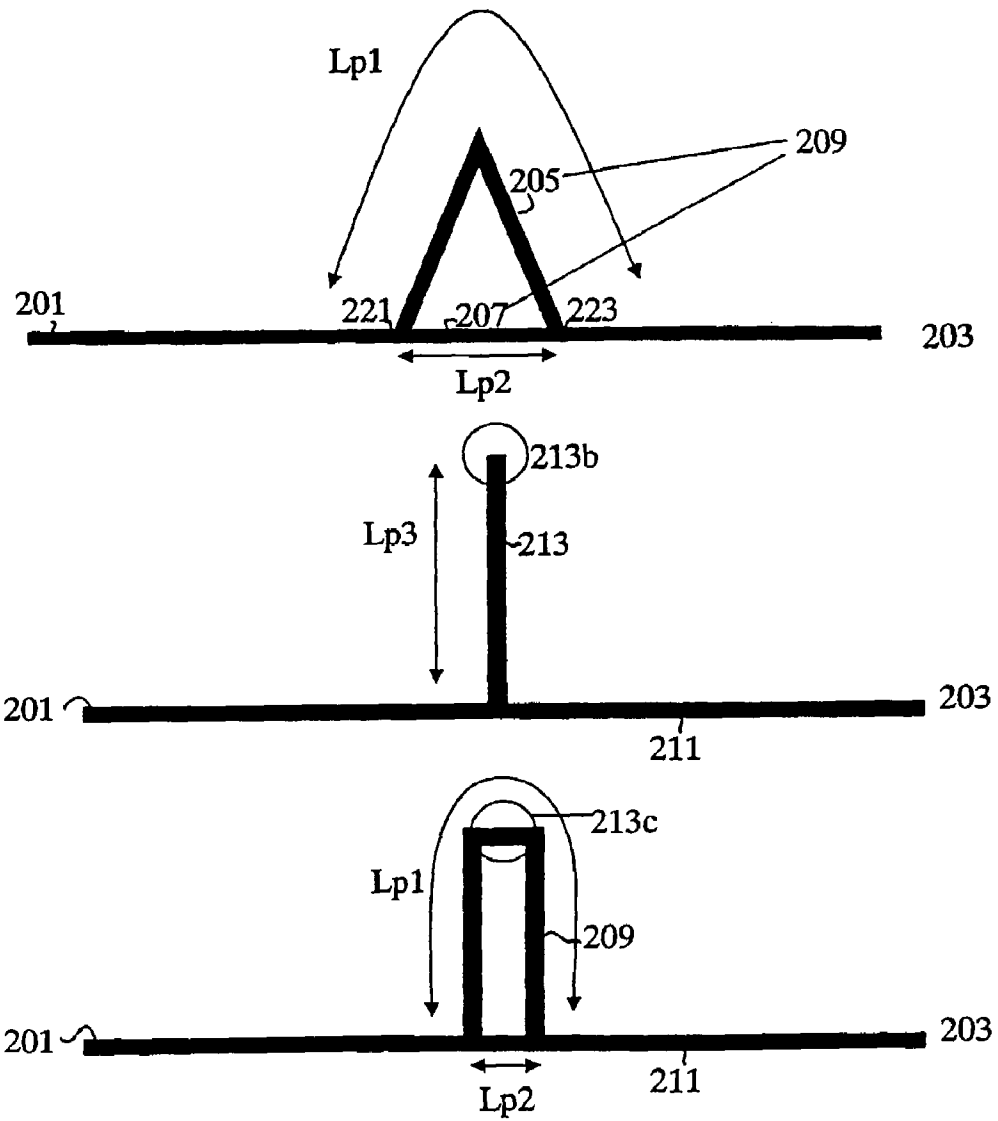
FIGS. 4A to 4C are schematic diagrams showing two possible circuits for a traditional high-frequency circuit structure having an infinite ground conductor structure on its rear face, each circuit having a branching portion along a signal line.

FIG. 4A shows a schematic diagram of a circuit in which a loop line 209, composed of a first path 205 and a second path 207, is connected between an input terminal 201 and an output terminal 203. The loop line satisfies a resonance condition under the conditions where a sum of the path length Lp1 of the first path 205 and the path length Lp2 of the second path 207 equals 1+ effective wavelength of the transmission signal. Such a loop line may sometimes be employed as a ring resonator. However, when the path lengths Lp1 and Lp2 are shorter than the effective wavelength of the transmission signal, the loop line 209 does not exhibit a steep frequency response, and therefore has had no particular reason for being employed in a usual high-frequency circuit.

In a traditional high-frequency circuit having a uniform ground conductor, even if fluctuations occur in the local high-frequency current distribution due to the introduction of a loop line, macroscopic fluctuations in the high-frequency characteristics between the two terminals 201 and 203 will be averaged out. In other words, the high-frequency characteristics of the loop line in a non-resonating state will not be much different from the high-frequency characteristics of a transmission line in which two paths are replaced by a single path whose characteristics represent an average of those of the two paths.

On the other hand, introduction of the loop line 209 into a slot antenna of the present invention provides a unique effect which cannot be obtained in the aforementioned traditional high-frequency circuit. This point will be described with reference to the upper schematic see-through view of FIG. 5. By replacing the linear-shaped feed line 261 with the loop line 209, near the portion of the ground conductor 12 where the slot 14 exists, it becomes possible to fluctuate the local high-frequency current distribution around the slot 14, thus changing the resonance characteristics of the slot antenna. The high-frequency current in the ground conductor 12 flows in the direction of an arrow 233 along the first path 205 branching from the first branching point 221, and also flows in the direction of an arrow 235 along the second path 207. As a result, different paths, along the directions of the arrows 233 and 235, can be created in the flow of the high-frequency current through the ground conductor 21, thus enabling the slot antenna to be excited at a plurality of places.

By introducing such local changes in the high-frequency current distribution in the ground conductor 12 near the slot, it becomes possible to drastically expand the operating band of the slot antenna.

Figure 6A:
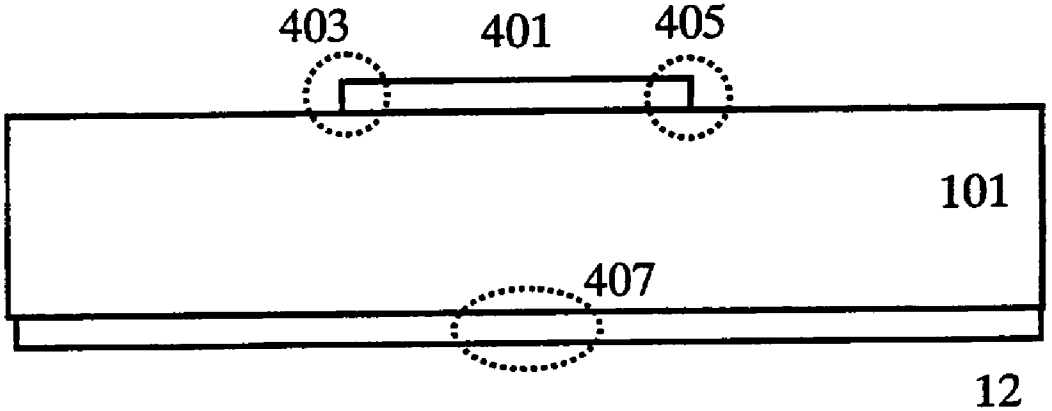
FIGS. 6A and 6B are cross-sectional structural diagrams illustrating places where a high-frequency current concentrates in a ground conductor of a transmission line.
Figure 6B:
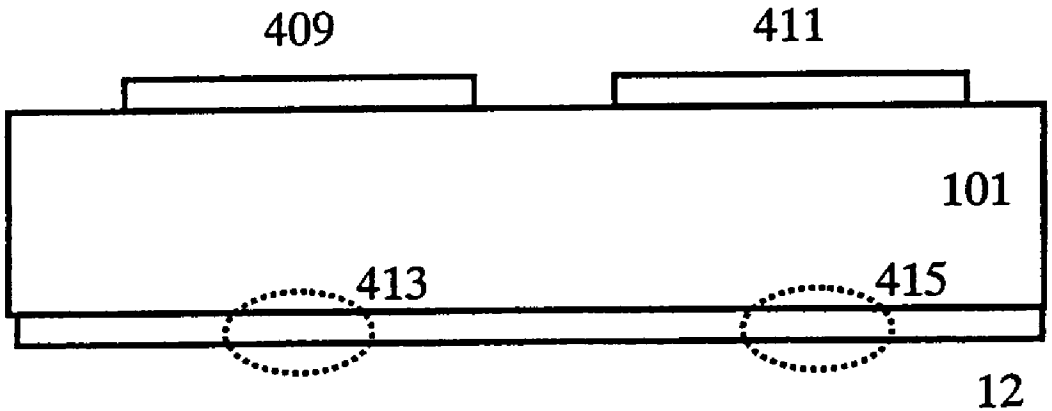

Generally speaking, during signal transmission, different high-frequency current distributions occur in the signal conductor side and the ground conductor side of the transmission line. Referring to FIGS. 6A and 6B, it will be described how the intensity distributions of a high-frequency current on the signal conductor side and the ground conductor side may fluctuate as a result of branching the signal conductor.

FIGS. 6A and 6B are schematic diagrams each showing a cross-sectional structure of a transmission line. In the transmission line of FIG. 6A, the signal conductor is not branched. Therefore, it is at the edges 403 and 405 of a signal conductor 401 that a concentration of the high-frequency current occurs in the signal conductor 401, and it is in a region 407 of the central portion opposing the signal conductor 401 that a concentration of the high-frequency current occurs in the ground conductor 12. Therefore, even if the width of the feed line 261 is increased in a conventional slot antenna, for example, no substantial changes can be caused in the distribution of the high-frequency current flowing through the ground conductor 12, and thus it will be difficult to realize a wideband operation similar to what is attained by the slot antenna of the present invention.

However, in the case where the signal conductor 401 is branched into two signal conductors 409 and 411, as in the example of FIG. 6B, a distribution of high-frequency current emerges in each of ground conductor regions 413 and 415 respectively opposing the branch lines 409 and 411. This contributes to the realization of a wideband operation.

The loop line of the slot antenna of the present invention not only functions to increase the number of places where the slot antenna is excitable to more than one, but also functions to adjust the electrical length of the feed line 261. Fluctuations in the electrical length of the feed line 261 due to the introduction of the loop line allows the feed line 261 to satisfy multiple resonance conditions. In other words, the resonance conditions are satisfied in a plurality of frequency bands. Therefore, such fluctuations further enhance the effect of expanding the operating band according to the present invention.

More specifically, in the conventional technique which has been described with reference to FIGS. 23A to 23C or FIG. 26, the distance t3 from the leading open-end point of the feed line to the place where it intersects the slot, or the value (t2+Ws÷2), has a close relationship with the effective wavelength at the center frequency f0. The power-supplying structure for a slot antenna as shown in FIG. 1 or 3 not only conforms to the designing principle for the feed line in conventional slot antennas (FIGS. 23A to 23C, FIG. 26), but also expands its operating band.

In the traditional slot antenna shown in FIG. 23, in order to satisfy the input matching conditions at the resonant frequency of the slot, the slot length is to be designed in accordance with the center frequency f0 of operation, and the length t3 is to be prescribed equal to a ¼ effective wavelength at the center frequency f0. By introducing the loop structure of the present invention near the slot of the feed line 26, it is ensured that separate resonant frequencies of the feed line 261 are obtained, i.e., one for a path with the shorter electrical length and another for a path with the longer electrical length, among the two paths composing the loop line. Thus, a multiple resonance operation is realized.

Figure 26:
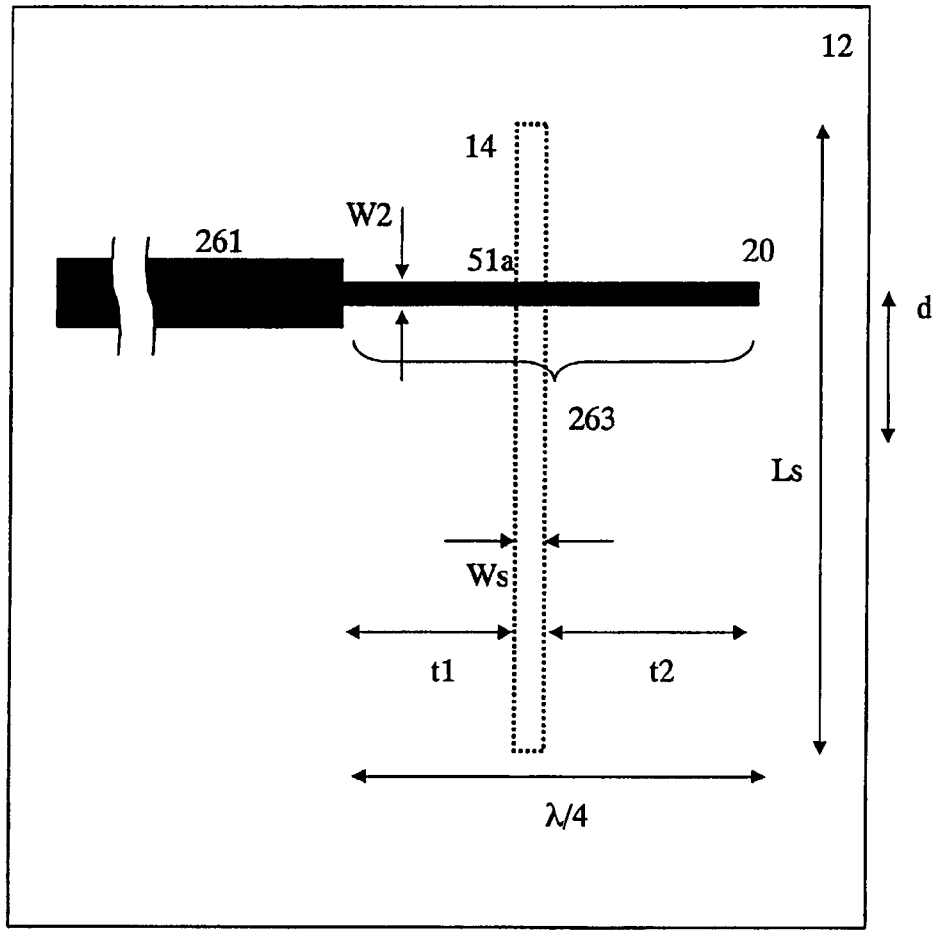
FIG. 26 is an upper schematic see-through view of a slot antenna structure described in Non-Patent Document 1.

Moreover, in the slot antenna shown in FIG. 26, the slot width Ws is prescribed to a large value, and the value t1+t2+Ws is prescribed equal to a ¼ effective wavelength at the center frequency f0. Moreover, the impedance of the transmission line in the ¼ effective wavelength region is prescribed at a high value, and the slot antenna is operated under the condition of t1≈t2. In this antenna, since a resonator structure that couples to the slot resonator is newly introduced into the equivalent circuit, input matching is established at two resonant frequencies, whereby the slot antenna attains a wideband operation. By introducing the loop line of the present invention near the slot of such a feed line 261, based on a difference in electrical length (i.e., the path with the shorter electrical length VS the path with the longer electrical length, among the two paths composing the loop line), it is ensured that a resonance phenomenon of coupling to the slot resonator occurs at a plurality of (two or more) frequencies. Thus, the matching condition which has already been wideband is made even more wideband.

Thus, the present invention enables operation in a wider band than that of a conventional slot antenna, based on the combination of a first function of enhancing the resonance phenomenon of the slot itself into multiple resonance and a second function of enhancing the resonance phenomenon of the feed line that couples to the slot into multiple resonance.

However, the slot antenna of the present invention must be used under the conditions where the loop line will not resonate, in order to maintain matching characteristics within a wide band. To take the loop line 209 of FIG. 4A for example, the loop length Lp, which is a sum of the path length Lp1 and the path length Lp2, must not be equal to 1× effective wavelength at any frequency in the operating band. In the case where a plurality of loop lines exist in the slot antenna of the present invention, this condition must be satisfied with respect to all of the loop lines. Therefore, the loop length of the largest loop line that is included in the antenna must be prescribed to be shorter than the effective wavelength at the upper limit frequency in the operating band.

A structure which is adopted in a traditional high-frequency circuit is an open stub shown in FIG. 4B. When the open stub 213 having a length Lp3 is connected in a branched form, the transmission line 211 satisfies a resonance condition at a frequency for which the length Lp3 equals a ¼ effective wavelength. In that case, in the signal transmission between the input terminal 201 and the output terminal 203, the open stub 213 functions as a band elimination filter.

Among the lines branching from the feed line of the slot antenna of the present invention, any one that does not constitute a part of the loop line may be a stub. However, its stub length must be prescribed to be less than a ¼ effective wavelength at the upper limit frequency in the operating band, at the most. The reason is that, if the open stub resonates and operates as a band elimination filter in the feed line, the operating band of the slot antenna will be limited so as to become narrower.

With reference to FIG. 4C showing an extreme example of a loop line, the advantages of a loop line over an open stub will be described. In the loop line 209 shown in FIG. 4C, as the length Lp2 is made extremely small, the loop line will apparently become infinitely closer to an open stub structure. However, the resonant frequency of the loop line in the case where the length Lp2 approximates zero is a frequency for which the length Lp1 equals an effective wavelength, and the resonant frequency of an open stub is a frequency for which the length Lp3 equals a ¼ effective wavelength. If the two structures are compared under conditions where a half of the length Lp1 is equal to the length Lp3, the resonant frequency of the loop line will prove to be twice the resonant frequency of the stub line.

As can be seen from the above description, in terms of the frequency band, a loop line is twice as effective a structure, as an open stub, to be adopted for a feed line which must avoid any redundant resonance phenomenon in a wide operating band.

Moreover, since an open-end point 213*b* of the open stub 213 of FIG. 4B is "open" in the circuitry, a high-frequency current will not flow therethrough. As a result, even if an open-end point 213*b* is provided near the slot, it will be difficult to establish electromagnetic coupling with the slot. On the other hand, a point 213*c* of the loop line 209 of FIG. 4C is not "open" in the circuitry, and therefore a high-frequency current is certain to flow therethrough. Thus, when provided near the slot, it will facilitate electromagnetic coupling with the slot. From this perspective, too, a loop line will be more advantageous than an open stub for obtaining the effects of the present invention.

Thus, in the slot antenna of the present invention, instead of a line or an open stub having a thick line width, a "loop line" is introduced into the feed line 261. Thus, the limitations of the operating band are cleverly avoided, thereby effectively realizing a wide band operation.

Figure 7:
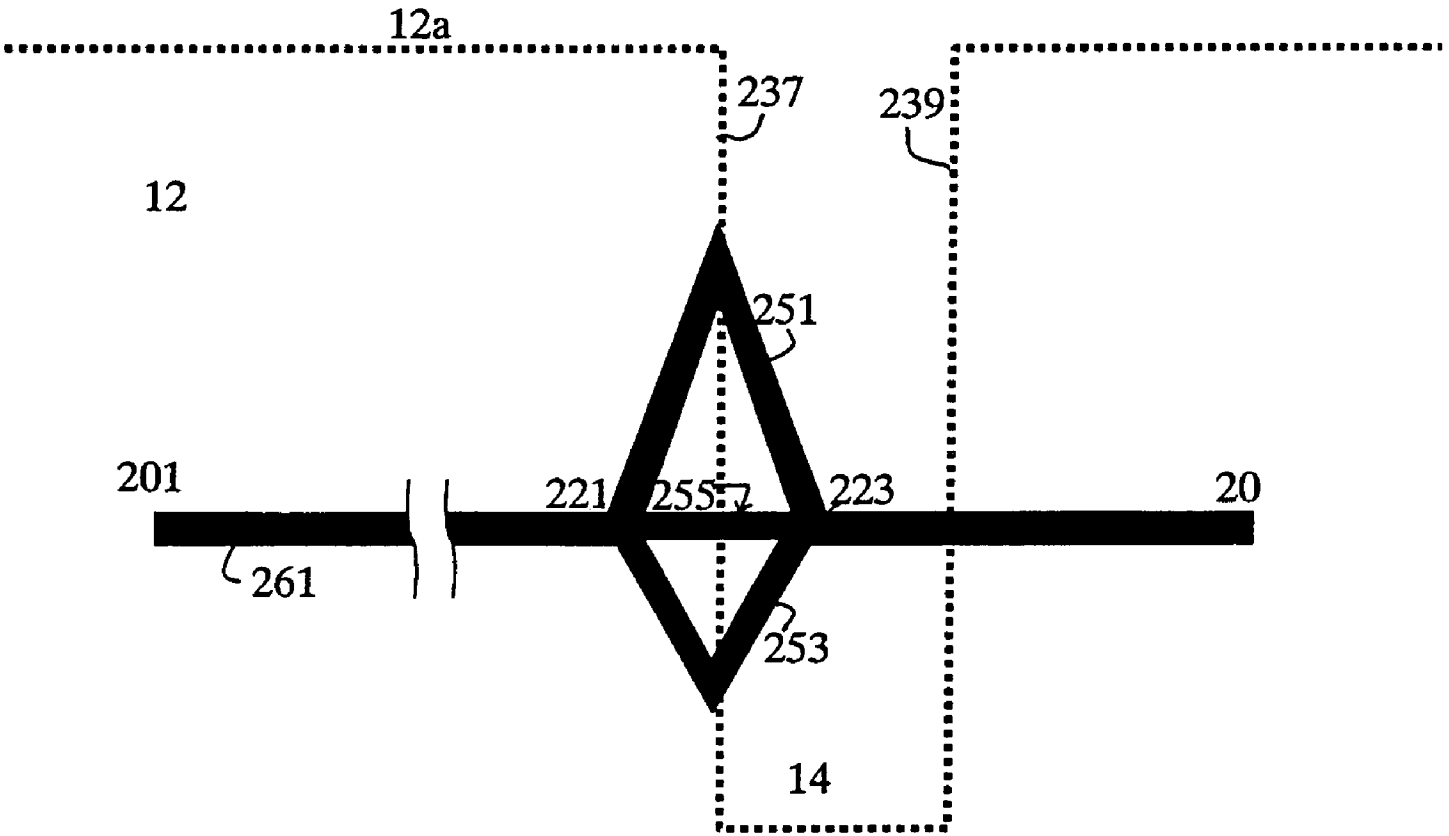
FIG. 7 is an upper schematic see-through view of an embodiment of the slot antenna according to the present invention.

FIG. 7 is an upper schematic see-through view of an embodiment in which three branch lines extend from the feed line 261. Although the number of branch lines extending from the feed line 261 may be prescribed to be three or more, not as drastic an expansion of the operating band will be obtained as in the case where there are two branch lines. Within the group of branch lines including a plurality of branches, it is only a path 251 extending through a place closest to the open end of the slot and a path 253 extending through a place farthest from the open end of the slot that has a high distribution intensity of high-frequency current, and therefore the high-frequency current flowing through a path 255 lying therebetween is not very intense. On the other hand, in the case where there are two branches lines, the loop length of the loop line formed by the path 251 and the path 253 may become longer than intended, thus resulting in a drop in the resonant frequency of the loop line. This may act as a limitation on the improvement of the upper limit frequency fH of the operating band of the slot antenna of the present invention. However, adding the path 255 will allow the loop line to be divided up, which is effective for the relaxation of such a limitation.

Figure 5:
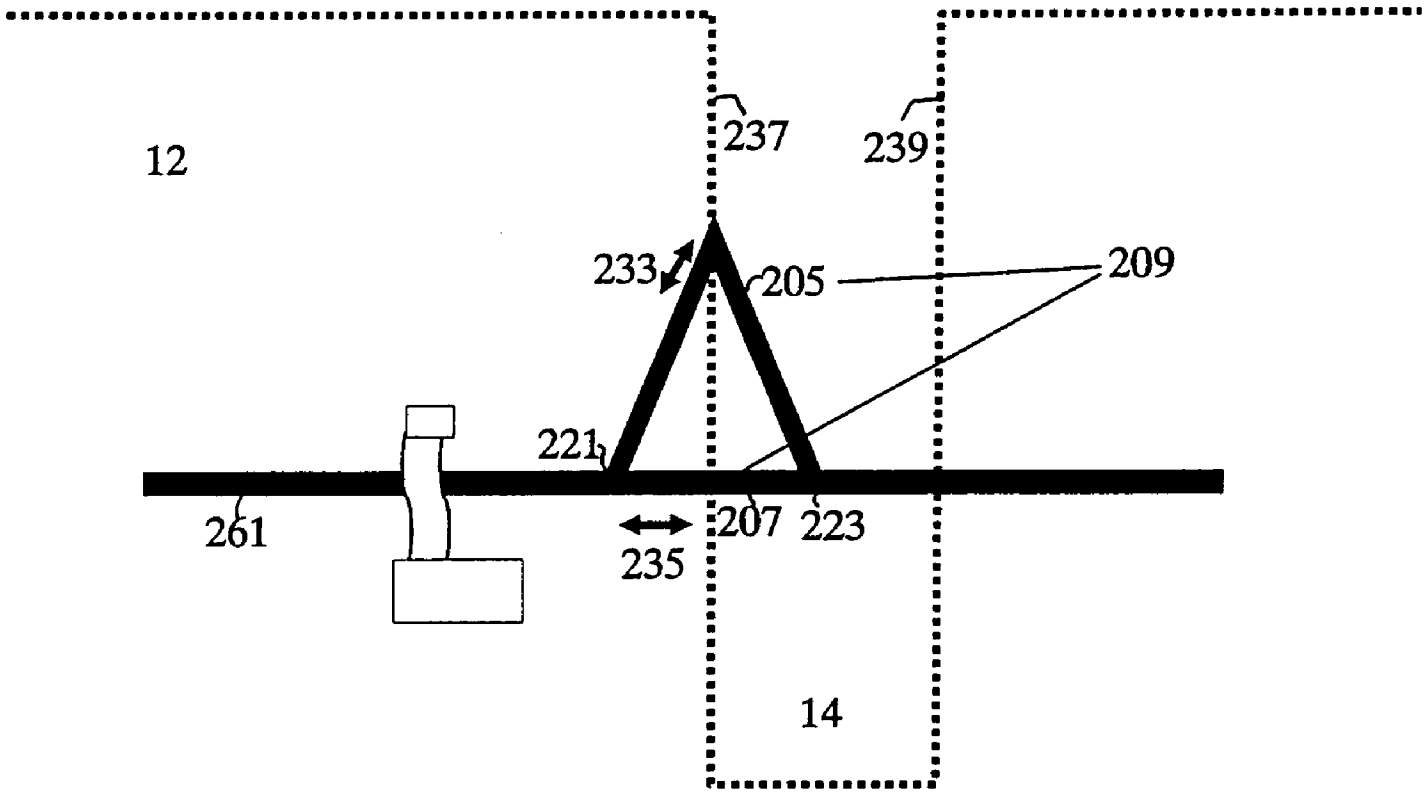
FIG. 5 is an upper schematic see-through view illustrating paths for a high-frequency current in a ground conductor of an embodiment of the slot antenna according to the present invention.

As for the relative positions of the loop line and the slot, as shown in FIG. 5, it is preferable that the first path 205 and the second path 207 composing the loop line 209 each intersect a border line between the slot 14 and the ground conductor 12, i.e., at least either one of the edges 237 and 239 of the slot.

Figure 8:
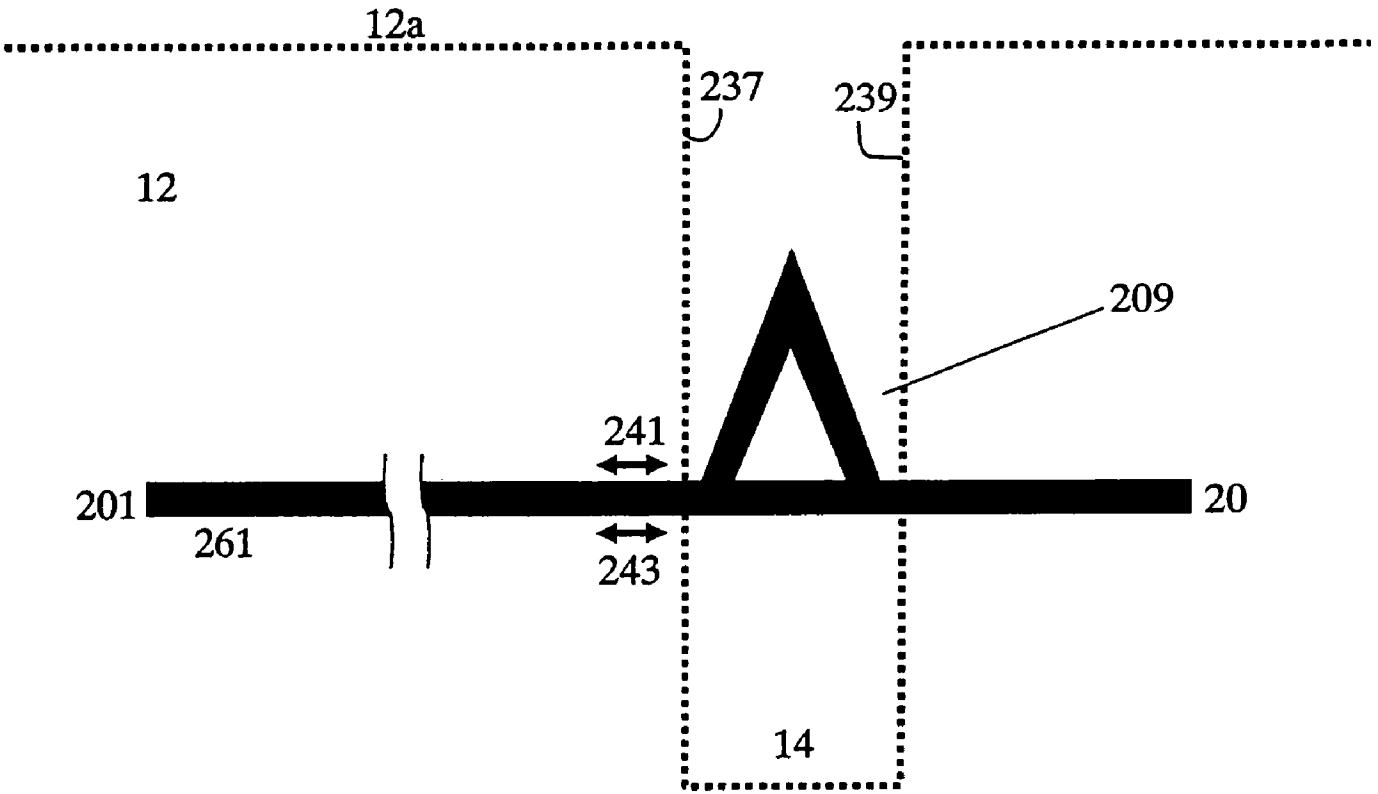
FIG. 8 is an upper schematic see-through view of an embodiment of the slot antenna according to the present invention.

However, as shown in FIG. 8, the effects of the present invention can also be obtained in a construction where, as seen from the upper face, the entire loop line 209 completely fits within the slot 14 such that the loop line 209 intersects neither edge 237 nor 239 of the slot. The reason is that, in the construction of FIG. 8, a path difference between the first path 205 and the second path 207 creates a phase difference between a current 241 in the ground conductor that corresponds to the high-frequency current flowing through the signal conductor along the first path 205 and a current 243 in the ground conductor that corresponds to the high-frequency current flowing through the signal conductor along the second path 207, whereby an effect of adjusting the input matching condition toward a wider band is obtained.

Figure 9:
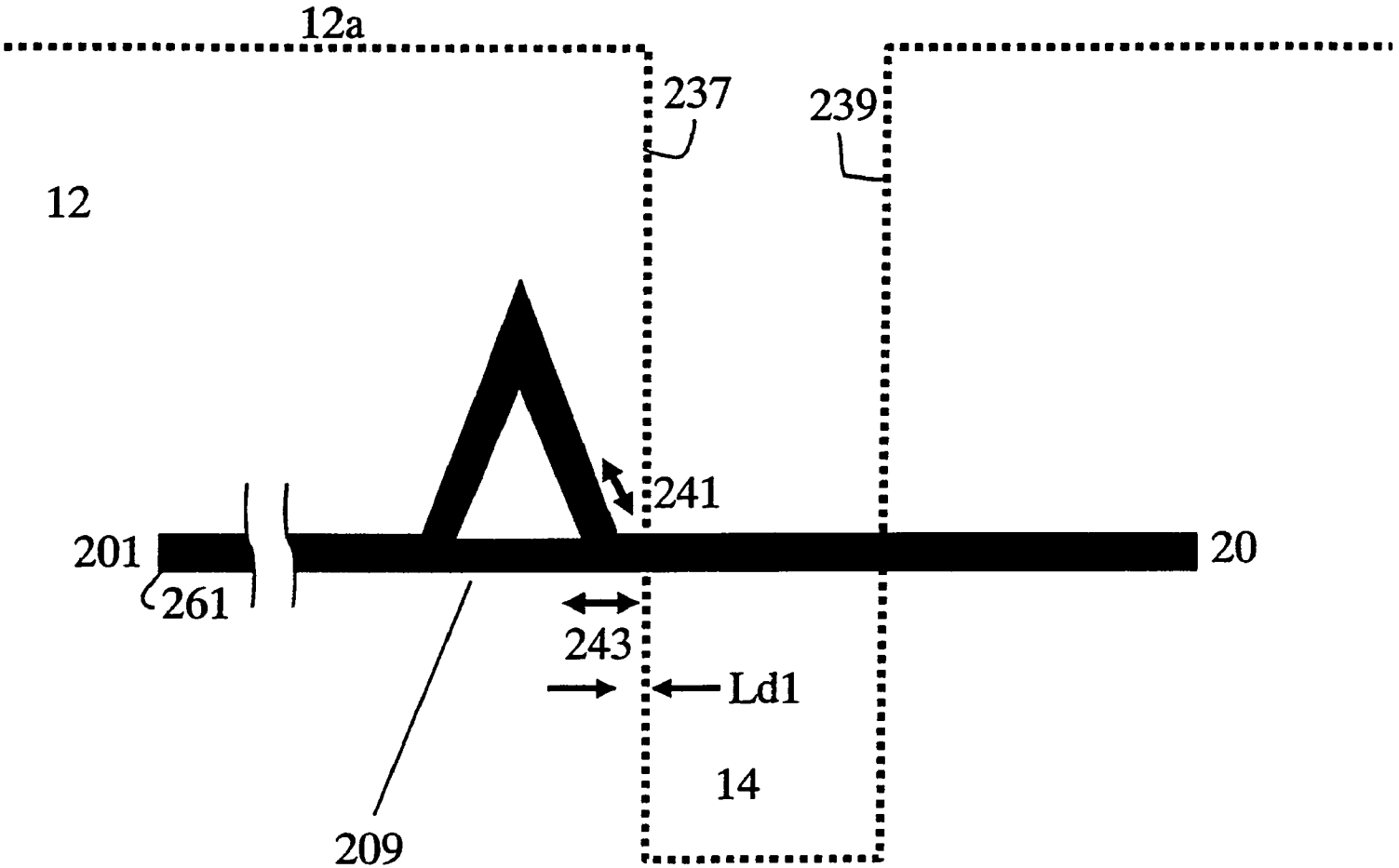
FIG. 9 is an upper schematic see-through view of an embodiment of the slot antenna according to the present invention.

Conversely, the effects of the present invention can also be obtained in another embodiment shown in FIG. 9, where the loop line 209 exists near the slot but does not intersect the slot 14 at all. As used herein, the loop line 209 being located "near the slot" refers to a condition where, strictly speaking, a distance Ld1 from the outermost point of the loop line 209 to a border line between the slot 14 and the ground conductor 12 (i.e., the edge 237 or the edge 239 of the slot 14) is less than 1× line width of the feed line 261. If the distance Ld1 is longer than the line width of the feed line 261, the phase difference between a local high-frequency current 241 and a high-frequency current 243 flowing through the ground conductor, corresponding to the phase difference between the high-frequency currents flowing at both ends of the signal conductor, will be canceled. As a result, the unique combinatory effects of the present invention, which are obtained based on the combination of the loop line 209 and the slot antenna, will not be obtained.

Figure 10:
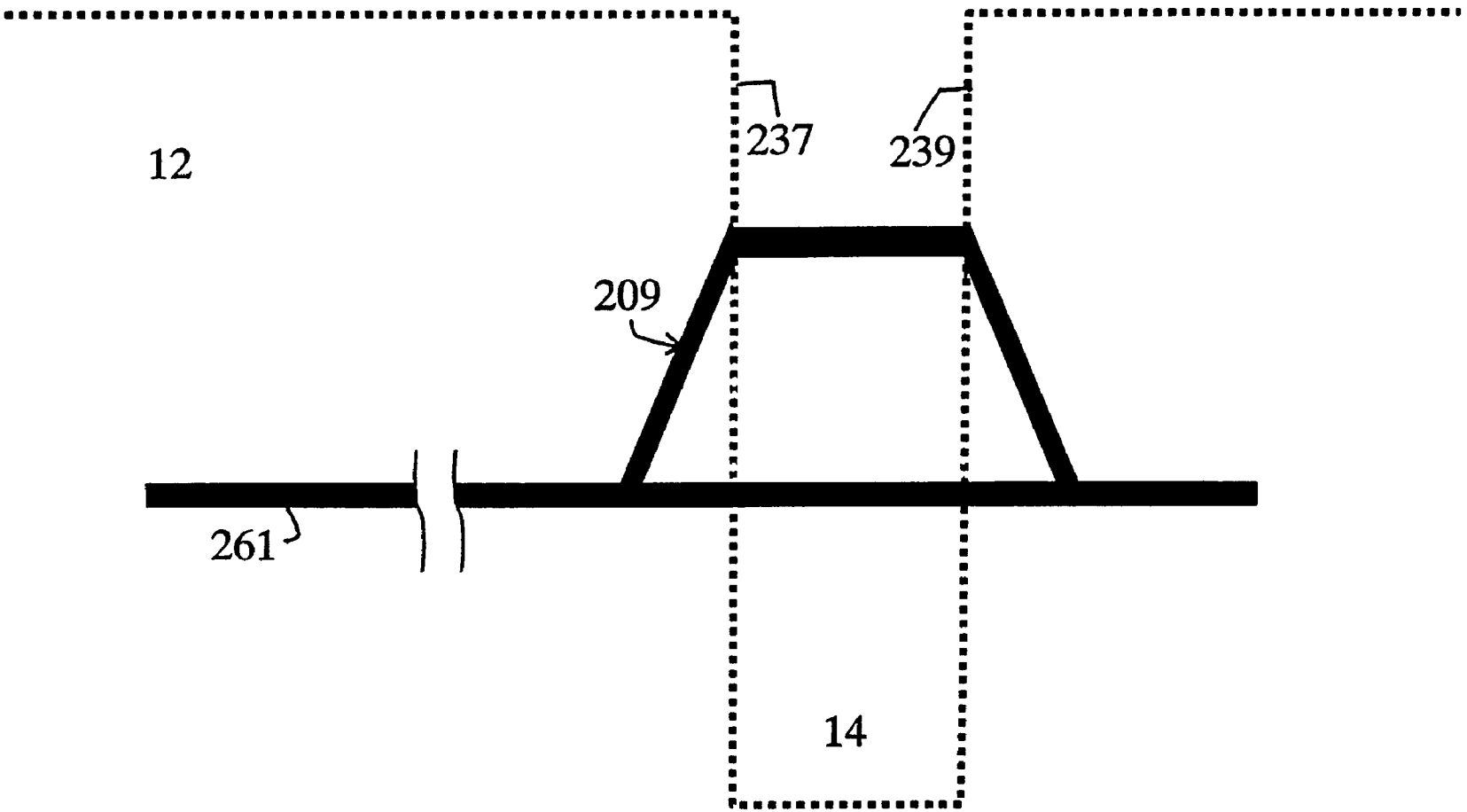
FIG. 10 is an upper schematic see-through view of an embodiment of the slot antenna according to the present invention.

As shown in FIG. 10, the loop line 209 may be designed so as to intersect both edges 237 and 239 of the slot 14. It will be seen that the loop line 209 of FIG. 10 is formed in a trapezoidal shape. Thus, there are no particular limitations as to the shape of the loop line 209. A plurality of loop lines 209 may be formed. In the case where a plurality of loop lines 209 are formed, such loop lines 209 may be connected in series, or connected in parallel as already shown in FIG. 7. Moreover, two loop lines 209 may be directly interconnected, or indirectly connected via a transmission line of an arbitrary shape.

Figure 11:
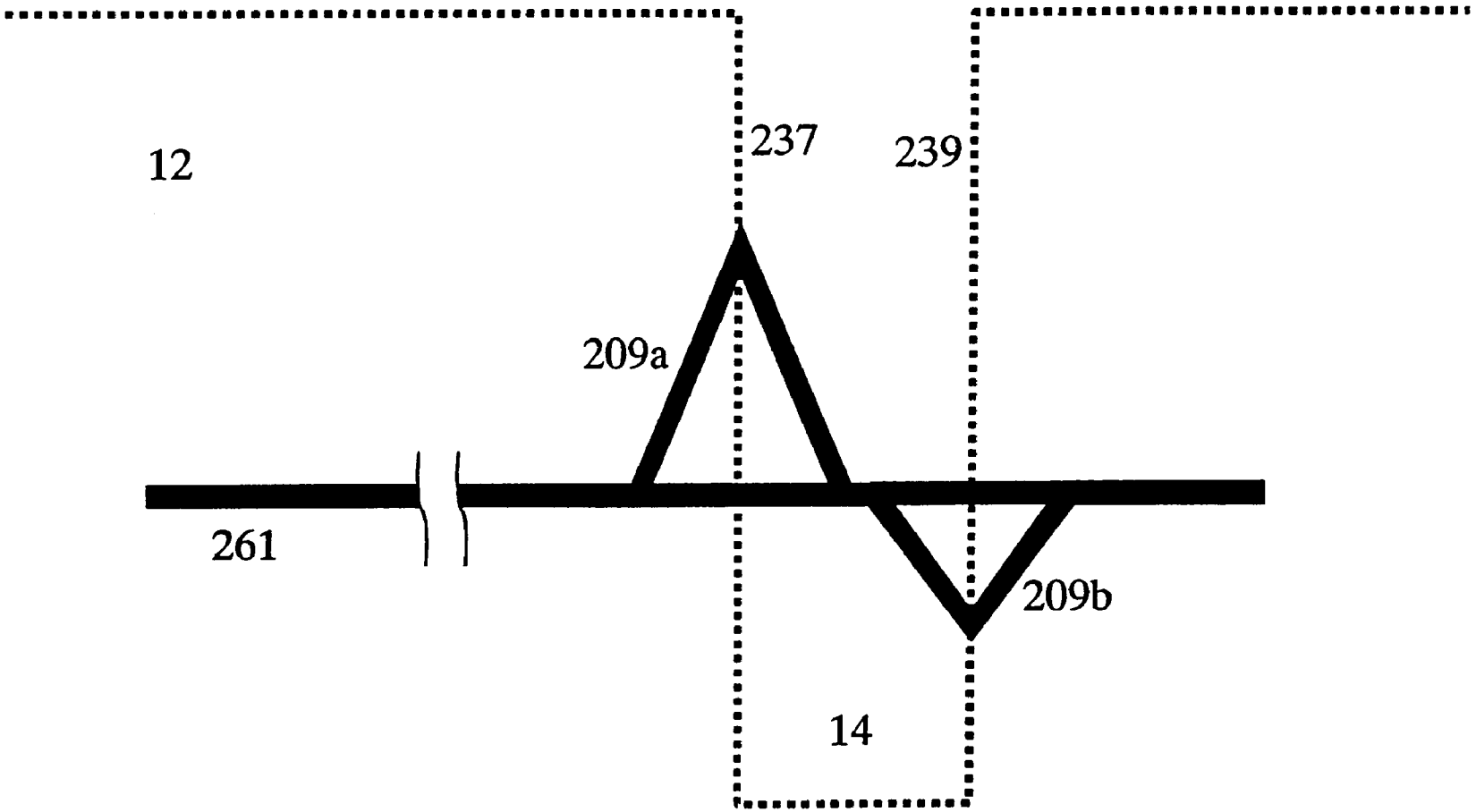
FIG. 11 is an upper schematic see-through view of an embodiment of the slot antenna according to the present invention.
Figure 12:
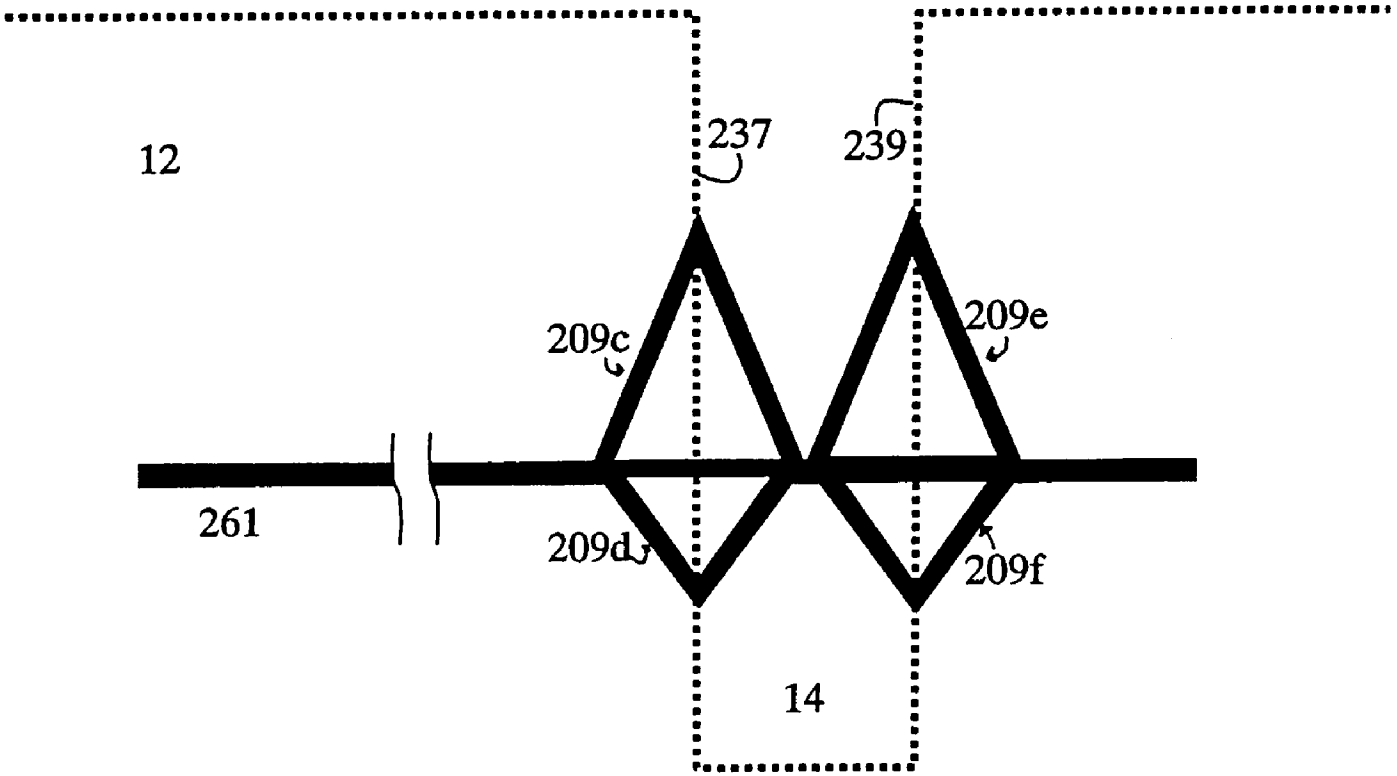
FIG. 12 is an upper schematic see-through view of an embodiment of the slot antenna according to the present invention.

As shown in FIG. 11, two loop lines 209*a* and 209*b* which respectively intersect the edges 237 and 239 of the slot 14 may be provided in series. Furthermore, as shown in FIG. 12, parallel-connected loop lines 209*c* and 209*d* each intersecting an edge 237 of the slot 14 and parallel-connected loop lines 209*e* and 209*f* each intersecting an edge 239 of the slot 14 may be provided in series.

It may be possible to place the frequency at which the ground conductor (having a finite area) of the slot antenna resonates so as to be close to the operating band of the slot antenna, thus obtaining a further wideband-ness. In other words, by prescribing the frequency at which the ground conductor itself resonates like a patch antenna and provides radiation characteristics to be a frequency which is lower than the resonant band of the slot antenna of the present invention, a further expansion of the input matching band can be realized.

The line width of the loop line 209 is preferably selected so that, equivalently, the same condition as the characteristic impedance of the feed line 261 which is connected to the input side or the leading open-end is obtained, or an even higher impedance is obtained. Specifically, in the case where the feed line 261 is branched into two portions, it is preferable that the loop line 209 consists of branch lines each having a line width which is half of that of the unbranched feed line 261. As is also clear from Non-Patent Document 1, the slot antenna itself tends to facilitate matching with the resistance value 50Ω of the input terminal due to coupling with the high-impedance line. Therefore, for realizing even lower-return characteristics, it is effective to, equivalently, increase the characteristic impedance of the feed line 261 near the slot 14 by introducing the loop line 209.

In the slot antenna of the present invention, the slot shape does not need to be rectangular, but may be replaced with any arbitrary curve. In particular, by connecting a large number of thin and short slots to the main slot in parallel, a serial inductance can be added to the main slot in terms of equivalent circuitry, which is preferable in practice because of being able to reduce the slot length of the main slot. Alternatively, the main slot may be given a narrow slot width and folded into a meandering shape or the like for downsizing, whereby the wide band effect of the slot antenna of the present invention can be similarly obtained.

EXAMPLE

Figure 13:
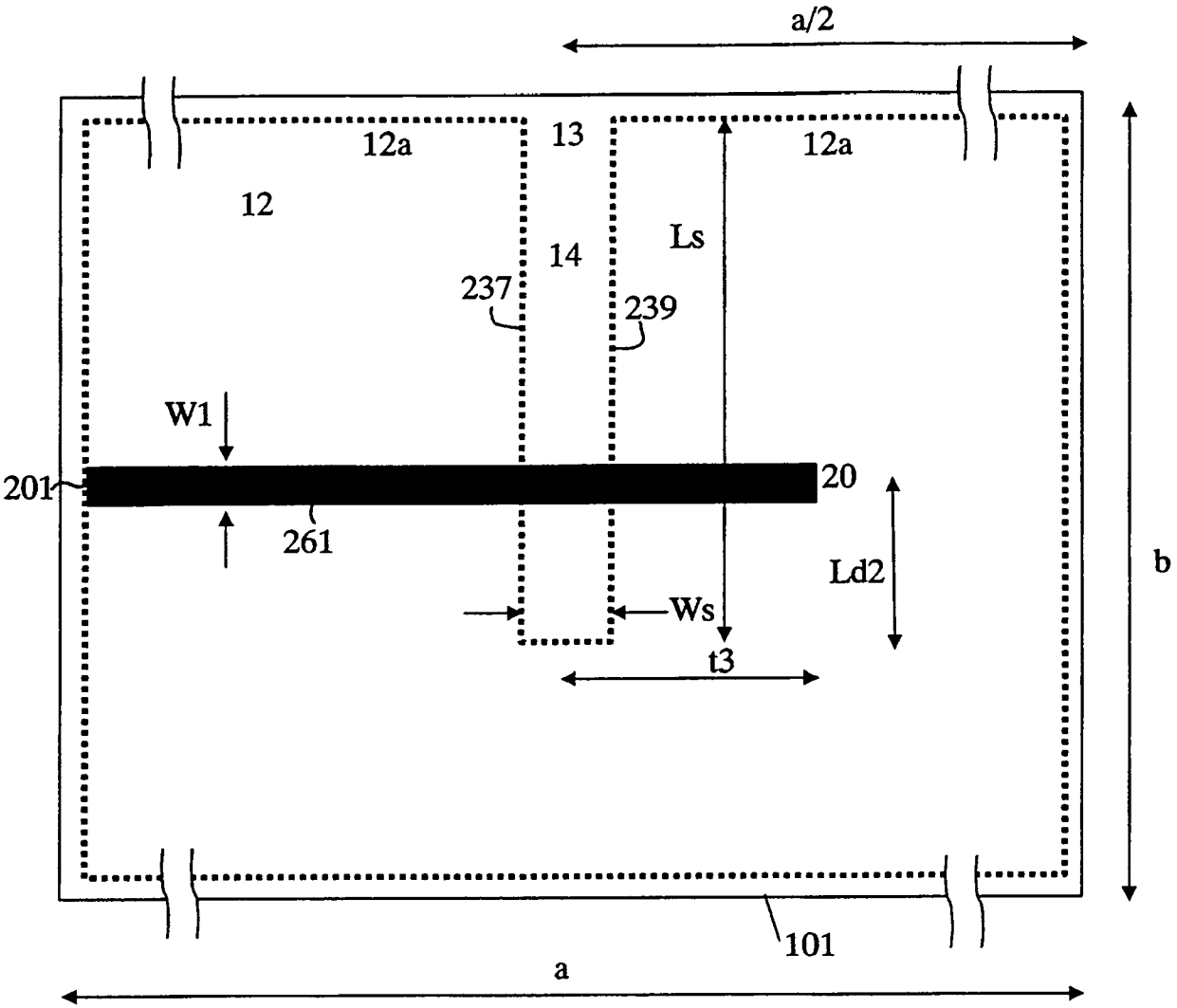
FIG. 13 is an upper schematic see-through view of Comparative Example 1.
Figure 14:
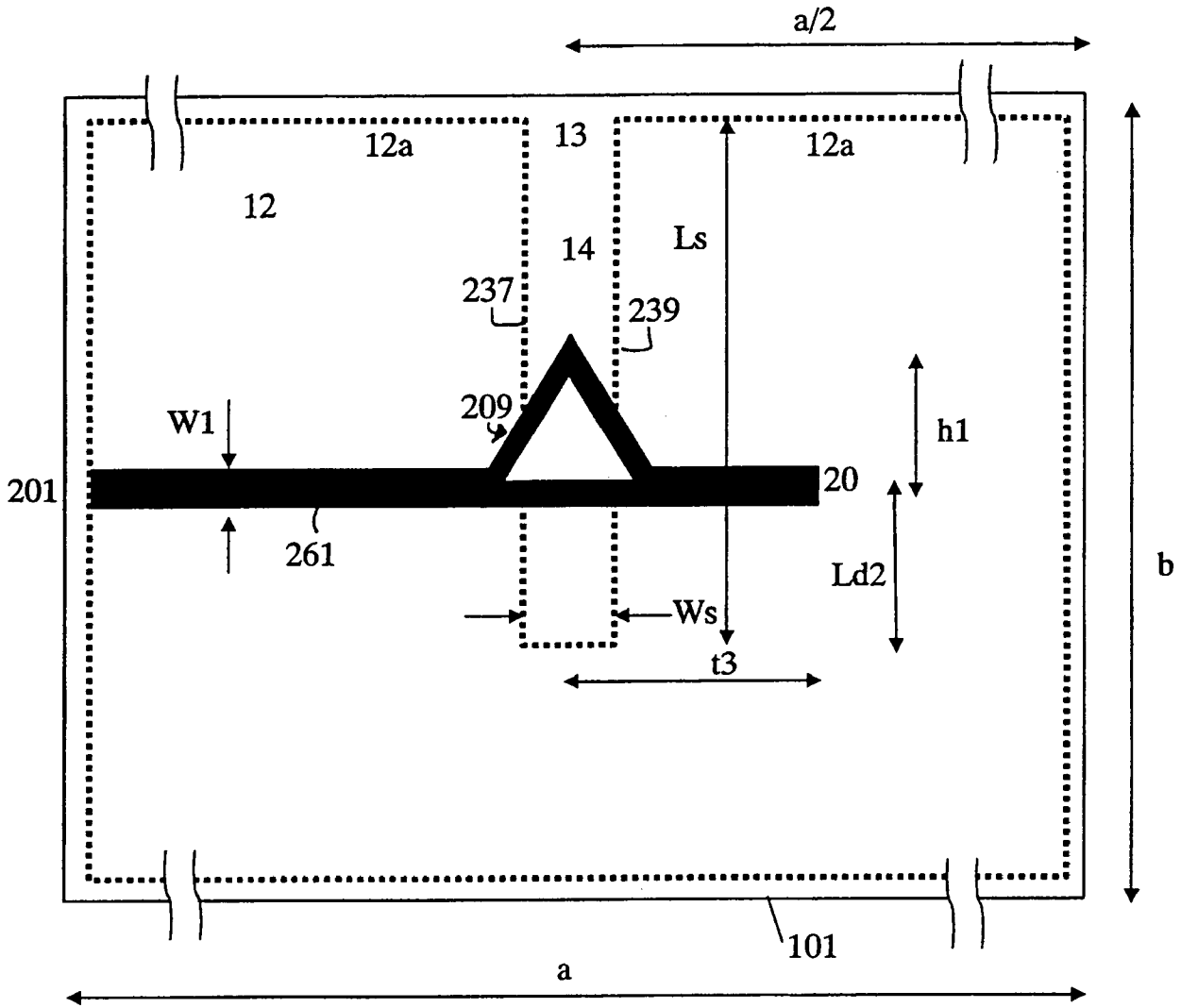

A slot antenna (Comparative Example 1) as shown in an upper schematic see-through view of FIG. 13 and a slot antenna (Example 1a) as shown in an upper schematic see-through view of FIG. 14 were produced. As a dielectric substrate 101, an FR4 substrate whose overall width was 500 microns and each of whose sides measured 60 mm (a=b=60 mm) was used. On the front face and the rear face of the substrate, a signal conductor pattern and a ground conductor pattern each having a thickness 20 microns were formed, respectively, by using a copper line. Each wiring pattern was formed by removing some regions of the metal layer through wet etching, and gold plating was provided on the surface to a thickness of 5 microns. An outer edge 12*a* of the ground conductor 12 remained inside the dielectric substrate 101, by no less than 100 microns, even at the closest points to the end faces of the dielectric substrate 101. In the figure, the ground conductor pattern is shown by a dotted line.

An SMA connector was connected to the input terminal 201, so that the produced antenna was connectable to a measurement system via a feed line 261 having a characteristic impedance of 50Ω. An assumption was made that a practically useful return intensity is −10 dB or less; and an "operating band" was defined as a frequency band in which such characteristics are satisfied. The feed line 261 had a line width W1 of 920 microns. In Comparative Example 1, the signal conductor did not include a loop line, and the feed line 261 maintained a line width of 920 microns also near the slot. There was a slot width Ws of 0.5 mm; an offset length Ld2 of 2.5 mm; and a slot length Ls of 12 mm. A distance t3 from the leading open-end point 20 to a feed point in the slot center was fixed at 10 mm. Comparative Example 1 exhibited an operating band from 4.63 GHz to 6.53 GHz, and a bandwidth ratio of 34.1%. Based on the frequency dependence of the return intensity characteristics, it was confirmed that a resonance phenomenon was occurring only at a frequency of 5.87 GHz.

On the other hand, as shown in FIG. 14, Example 1a was produced in which a linear-shaped portion of the signal conductor near the slot 14 in Comparative Example 1 was replaced by a loop line 209 having the shape of an isosceles triangle, with its protrusion protruding toward the open end 13 of the slot. Other than the above change, the structural parameters of Example 1a were kept identical to those of Comparative Example 1. The isosceles triangle of the loop line 209 had a base length of 1.5 mm and a height h1 of 2.5 mm. The loop line 209 had a line width of 460 microns, which is half of the line width W1 of the 50Ω line. Example 1a exhibited an operating band from 4.09 GHz to 7.01 GHz, and a bandwidth ratio of 52.6%.

Moreover, the return intensity of Example 1a exhibited local minimum values at the two frequencies of 4.75 GHz and 6.38 GHz, indicative of a multiple resonance operation.

Figure 15:
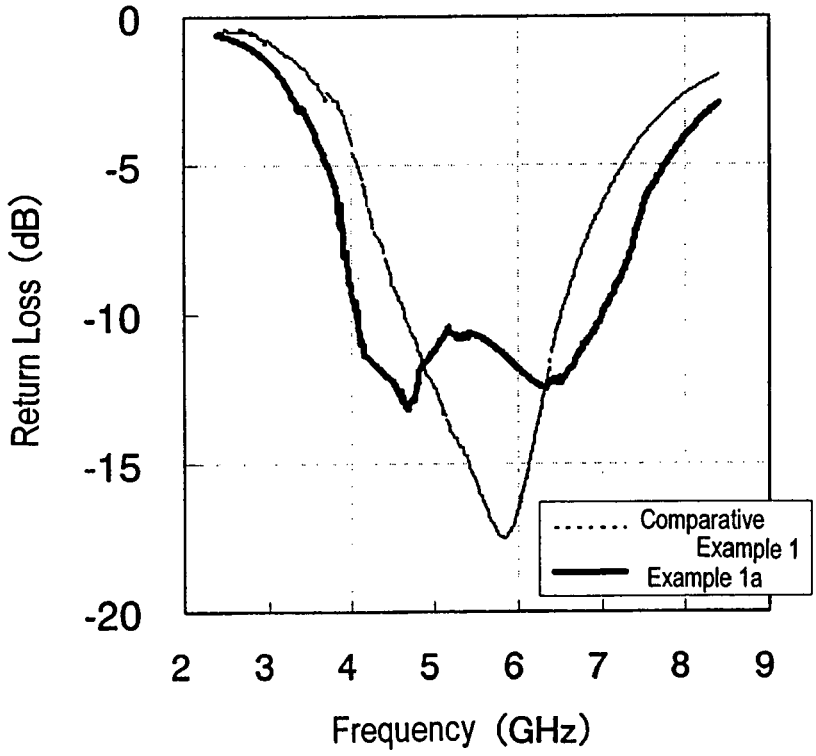

FIG. 15 shows frequency dependence of the return intensity characteristics of Example 1 and Comparative Example 1. In FIG. 15, a solid line indicates the characteristics of Example 1a, whereas a dotted line indicates the characteristics of Comparative Example 1. FIG. 15 clearly shows the effects of the present invention, i.e., change from single resonance characteristics to multiple resonance characteristics and expansion of the operating band.

Next, Example 1b was produced which had a modified loop line structure from that of Example 1a. In Example 1a, the protrusion of the isosceles triangle of the loop line protrudes toward the slot open end 13. On the other hand, in Example 1b, the loop line is reversed in its orientation so that the isosceles triangle protrudes in the depth direction of the slot. The other structural parameters were the same as those in Example 1a.

Example 1b exhibited an operating band from 4.45 GHz to 6.82 GHz, and a bandwidth ratio of 42.1%. Example 1b also attained a wider-band operation than that of Comparative Example 1. Examples 1c and 1d were similarly produced as follows. In Example 1a, the center of gravity of the isosceles triangle of the loop line is at the central portion of the gap of the slot. On the other hand, the center of gravity was moved by 0.25 mm toward the input terminal in Example 1c, and 0.25 mm toward the leading open point 20 in Example 1d.

In Examples 1c and 1d, the center of gravity of the isosceles triangle was set at a point opposing the edge 237 or 239 of the ground conductor 12, respectively. Example 1c exhibited an operating band from 4.72 GHz to 7.05 GHz, and a bandwidth ratio of 39.6%. Example 1d exhibited an operating band from 4.04 GHz to 6.28 GHz, and a bandwidth ratio of 43.4%. From the characteristics of Examples 1c and 1d, it was found that introducing a loop line at the input terminal side of the feed line contributes to wideband operation on the high-frequency side of the band, and introducing a loop line at the leading open point side of the feed line contributes to wideband operation on the low-frequency side of the band. Each of Examples 1a, 1b, 1c, and 1d realizes a low-return operation with a bandwidth ratio which is wider than that of Comparative Example 1, thus proving the advantageous effects of the present invention. Table 2 shows a comparison between the characteristics of Examples 1a to 1d and the characteristics of Comparative Example 1.

TABLE 2

| | operating frequency band | | |
|---|---|---|---|
| | lower end (GHz) | higher end (GHz) | bandwidth ratio (%) |
| Example 1a | 4.09 | 7.01 | 52.6 |
| Example 1b | 4.45 | 6.82 | 42.1 |
| Example 1c | 4.72 | 7.05 | 39.6 |
| Example 1d | 4.04 | 6.28 | 43.4 |
| Comparative Example 1 | 4.63 | 6.53 | 34.1 |

Figure 16:
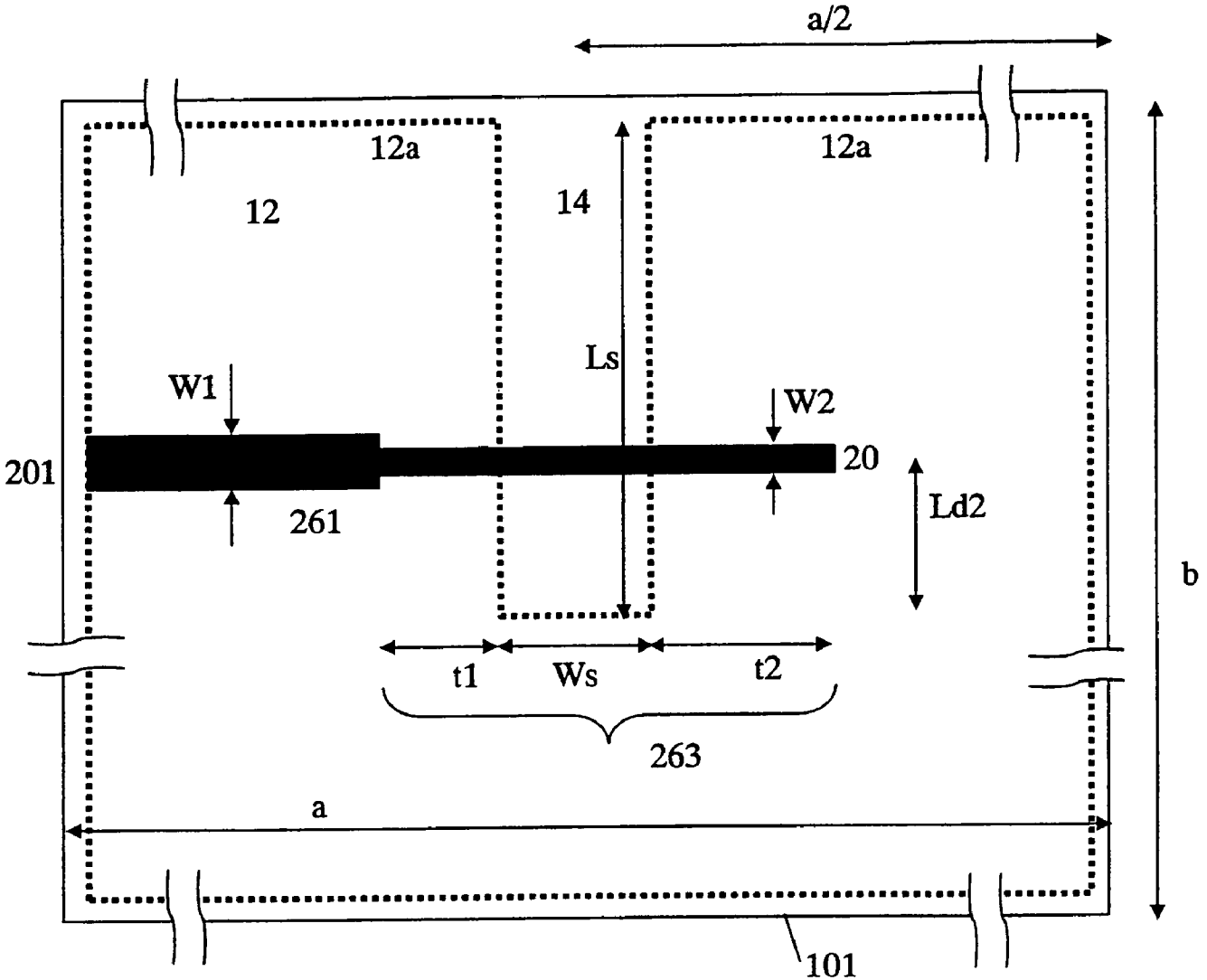
FIG. 16 is an upper schematic see-through view of Comparative Example 2.

Next, Comparative Example 2 was produced, which was a ¼ wavelength slot antenna version of the ½ wavelength slot antenna disclosed in Non-Patent Document 1 having multiple resonance characteristics. FIG. 16 shows an upper schematic see-through view of Comparative Example 2.

In the feed line 261 of Comparative Example 1, there was the same impedance of 50Ω from the input terminal 201 to the leading open-end point 20. In Comparative Example 2, the feed line 261 was partially replaced by a high-impedance line 263 over a distance of (t1+t2+Ws) from the leading open-end point 20. Specifically, the following conditions were adopted: W2=250 microns, Ws=4 mm, t1=3.5 mm, and t2=4 mm.

Comparative Example 2 exhibited an operating band from 3.46 GHz to 5.67 GHz, and a bandwidth ratio of 48.4%. At the two frequencies of 3.77 GHz and 5.27 GHz, the return loss showed local minimum values. Thus, the effect of realizing a multiple resonance operation as disclosed in Non-Patent Document 1 was obtained.

Figure 17:
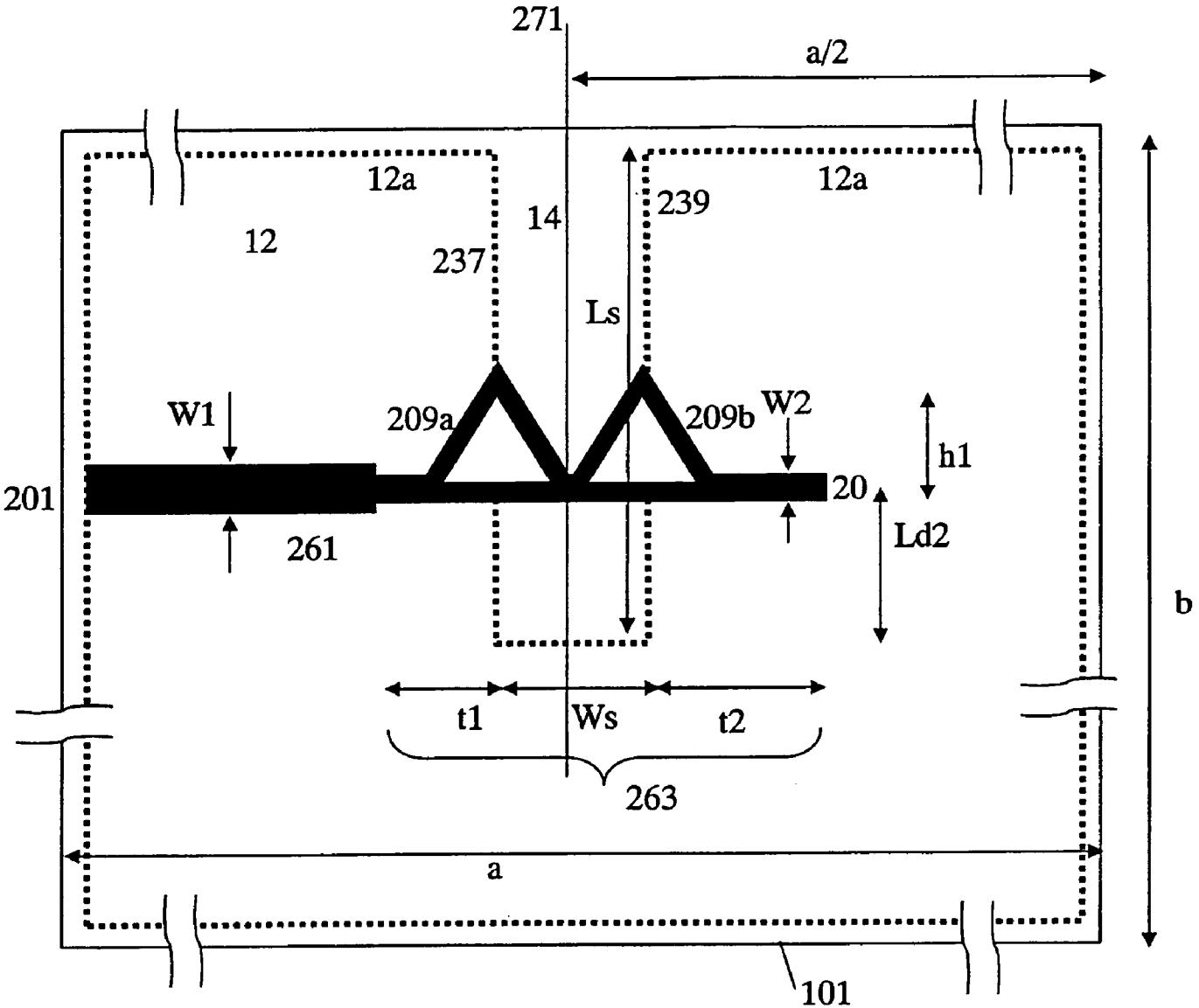

On the other hand, Example 2a was produced, which included a loop line structure introduced to the linear-shaped high-impedance region 263 of Comparative Example 2. FIG. 17 shows an upper schematic see-through view of Example 2a. In Example 2a, triangular loop lines 209*a* and 209*b* were disposed in series, near the slot 14. Specifically, the loop line 209*a* was placed so as to oppose the edge 237 of the slot, and the loop line 209*b* was placed so as to oppose the edge 239. The loop lines 209*a* and 209*b* are of a mirror-symmetrical relationship with each other, against a plane of symmetry that extends through a line of mirror symmetry 271 in the center of the gap of the slot 14 perpendicularly to the substrate. Each of the loop lines 209*a* and 209*b* had the shape of an isosceles triangle, with a base of 4 mm, a height h1 of 2.5 mm, and a line width of 125 microns.

Example 2a exhibit an operating band from 3.13 GHz to 8.48 GHz, and a bandwidth ratio of 92.2%. Example 2a attained a bandwidth ratio-expanding effect of 1.9 times over Comparative Example 2.

Figure 18:
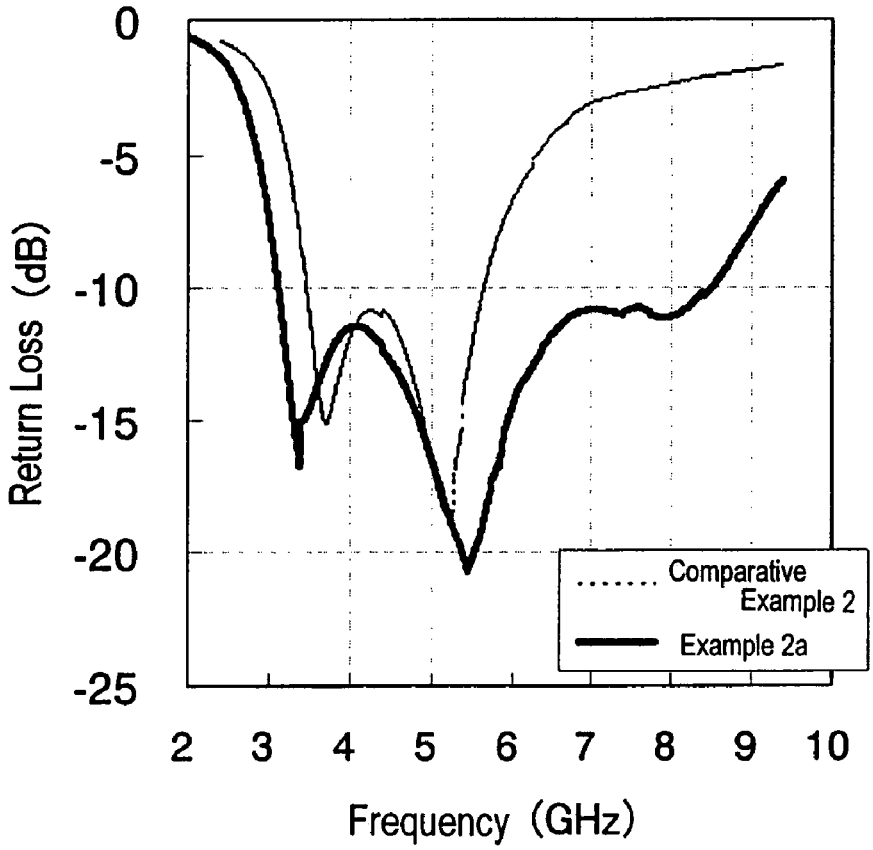

FIG. 18 shows frequency dependence of the return intensity characteristics of Comparative Example 2 and Example 2a. A dotted line indicates the characteristics of Comparative Example 2, whereas a solid line indicates the characteristics of Example 2a. FIG. 18 proves that Example 2a realizes ultrawideband characteristics which are superior to the wideband characteristics of Comparative Example 2, which already embody multiple resonance characteristics.

Figure 19:
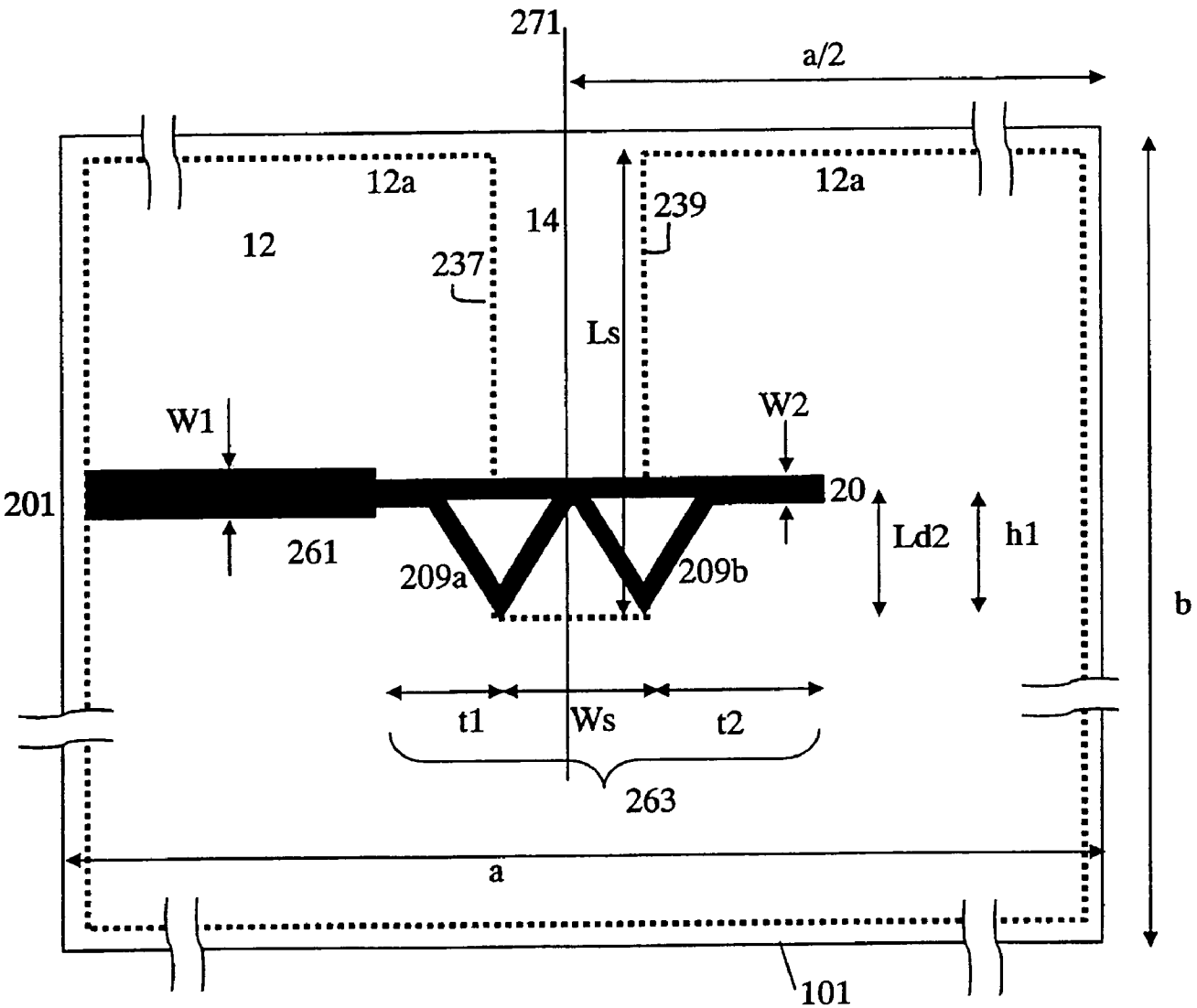
FIG. 19 is an upper schematic see-through view of Example 2b.

Next, Example 2b was produced, whose upper schematic see-through view is shown in FIG. 19. In Example 2a, the protrusions of the triangles of the two loop lines 209*a* and 209*b* are pointed toward the open end of the slot. On the other hand, in Example 2b, the loop lines are reversed in their orientation so that the protrusions of the triangles are pointed in the depth direction of the slot. Other than the orientation of the loop lines 209*a* and 209*b*, the structural parameters were the same between Example 2a and Example 2b.

Example 2b exhibited an operating band from 3.34 GHz to 6.29 GHz, and a bandwidth ratio of 61.3%. Example 2b attained a bandwidth ratio-expanding effect of 1.27 times over Comparative Example 2.

Figure 20:
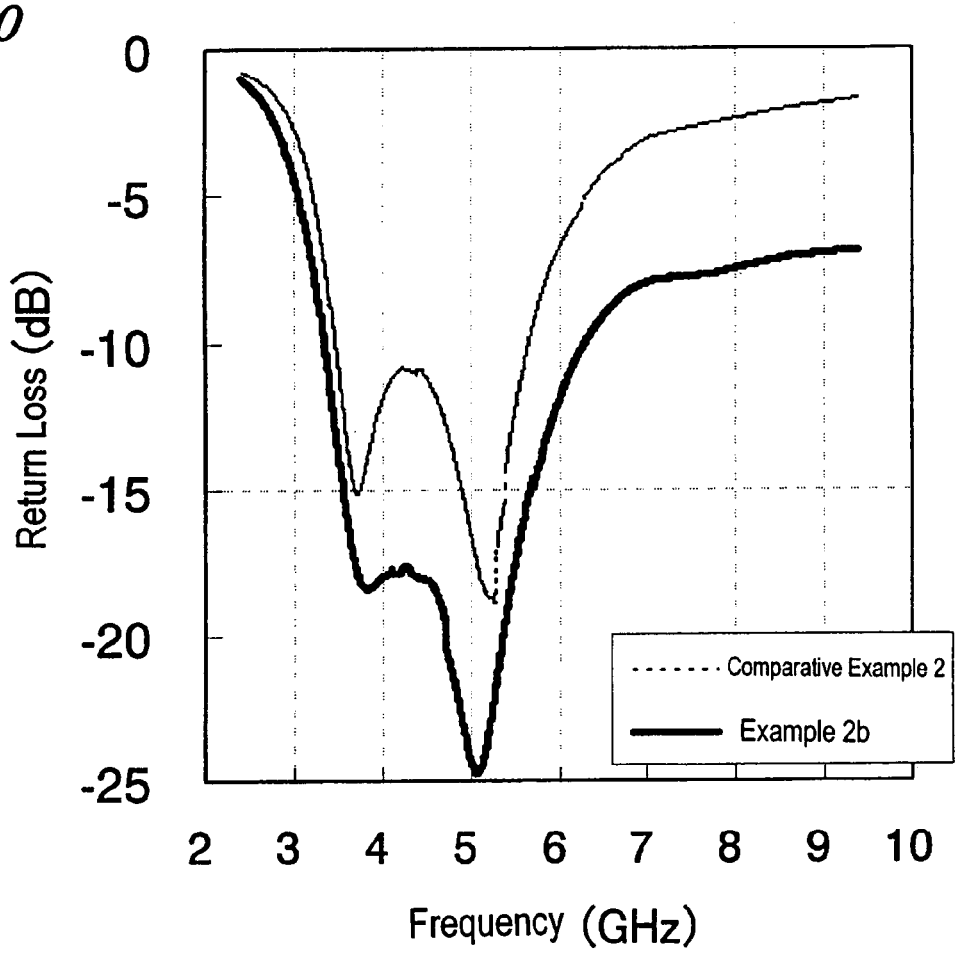
FIG. 20 is a comparison graph showing frequency dependence of the return intensity characteristics of Comparative Example 2 and Example 2b.

FIG. 20 shows frequency dependence of the return intensity characteristics of Comparative Example 2 and Example 2b. In Example 2b, the operating band is not as wide as that of Example 2a. However, in terms of return characteristics in the high-frequency band from 7 GHz to 9 GHz, Example 2b clearly exhibits an improvement of 4 dB or more over Comparative Example 2. Thus, it was proven that the structure of the present invention attains an improvement in band characteristics as compared to a slot antenna of the conventional structure.

Figure 21:
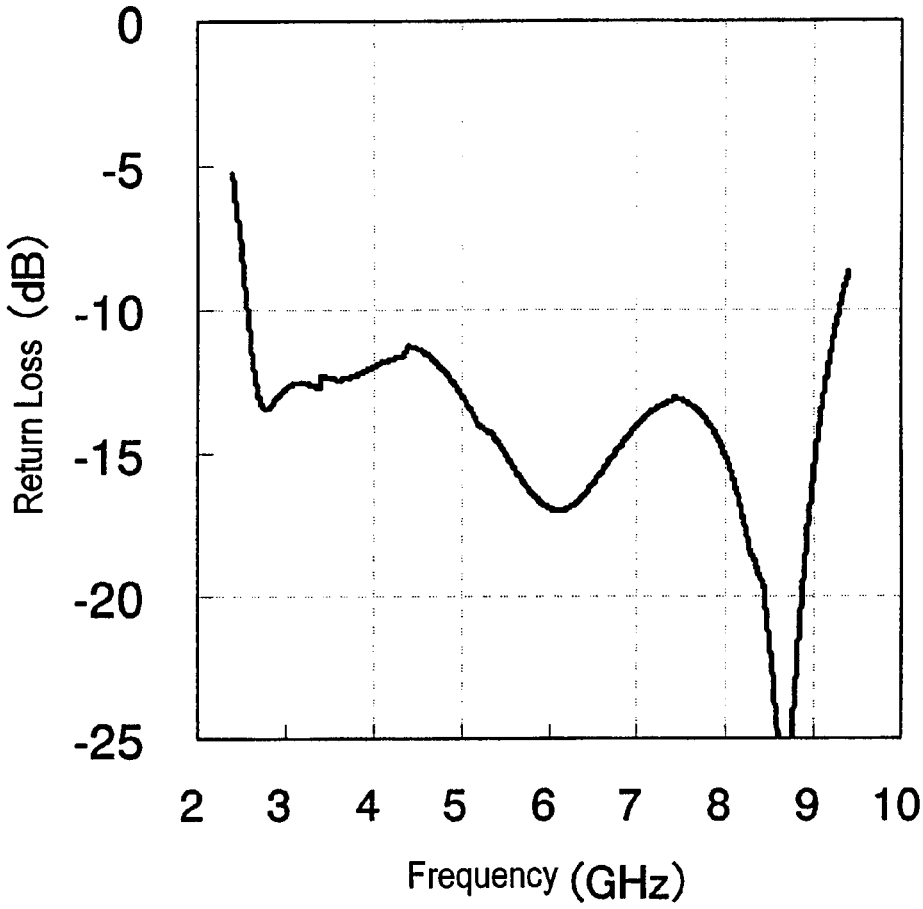
FIG. 21 is a return intensity characteristic graph of Example 3.

Next, Example 3 was produced. The lateral width a of the ground conductor 12, which was 60 mm in Example 2a, was reduced to 35 mm in Example 3. The other structural parameters were the same as those in Example 2a, except that the vertical length b of the ground conductor 12 (which did not show much influence on the return characteristics) was reduced to 25 mm. The ground conductor 12 with the reduced lateral width functions as an antenna that resonates near 2.7 GHz. Thus, as compared to the slot antenna of Example 2a, which already achieved an operating band represented by a bandwidth ratio of 92.2%, an even wider-band operation was attained. Specifically, as seen from FIG. 21 showing frequency dependence of return characteristics, Example 3 exhibited an operating band from 2.57 GHz to 9.29 GHz, and a bandwidth ratio as large as 113.3%. The bandwidth ratio of 113.3% is an even wider value than the bandwidth ratio of 109.5%, which represents a band from 3.1 GHz to 10.6 GHz that is used for short-range wireless communications. A comparison between the characteristics of Example 2a, Example 2b, Example 3, and Comparative Example 2 is shown in Table 3.

TABLE 3

| | operating frequency band | | |
|---|---|---|---|
| | lower end (GHz) | higher end (GHz) | bandwidth ratio (%) |
| Example 2a | 3.13 | 8.48 | 92.2 |
| Example 2b | 3.34 | 6.29 | 61.3 |
| Example 3c | 2.57 | 9.29 | 113.3 |
| Comparative Example 2 | 3.46 | 5.67 | 48.4 |

Figure 22:
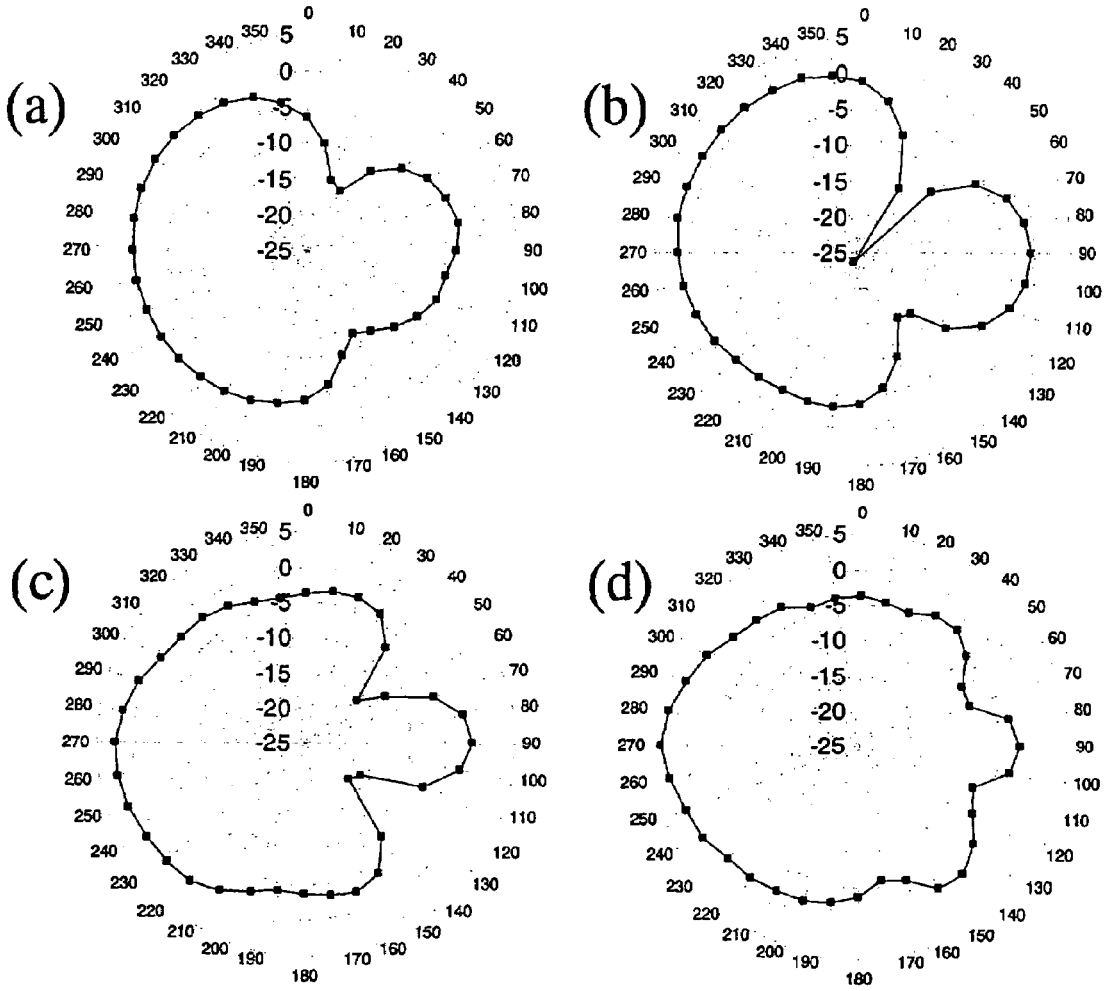
FIG. 22 includes (a) to (d), which are angle-dependence characteristic diagrams of the radiation intensity of the slot antenna of Example 3.
Figure 23A:
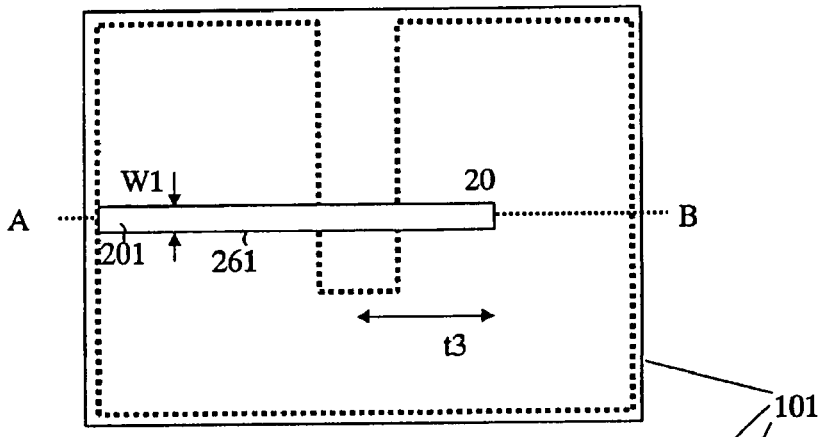
FIGS. 23A to 23C are diagrams showing a traditional ¼ wavelength slot antenna.
Figure 23B:
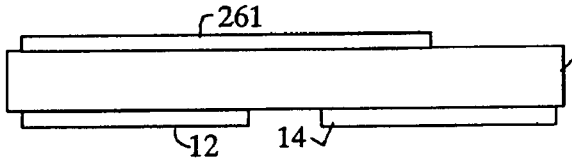
Figure 23C:
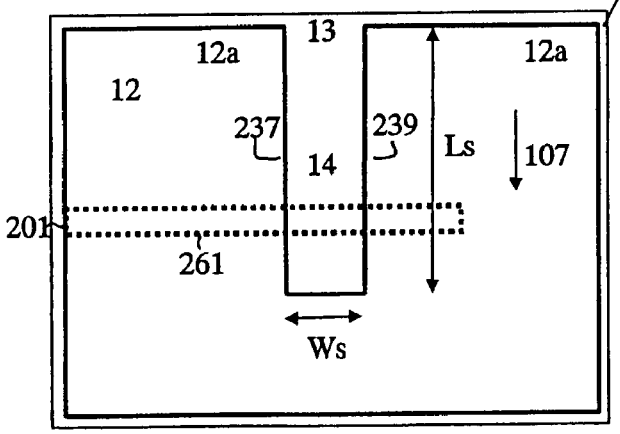
Figure 24A:
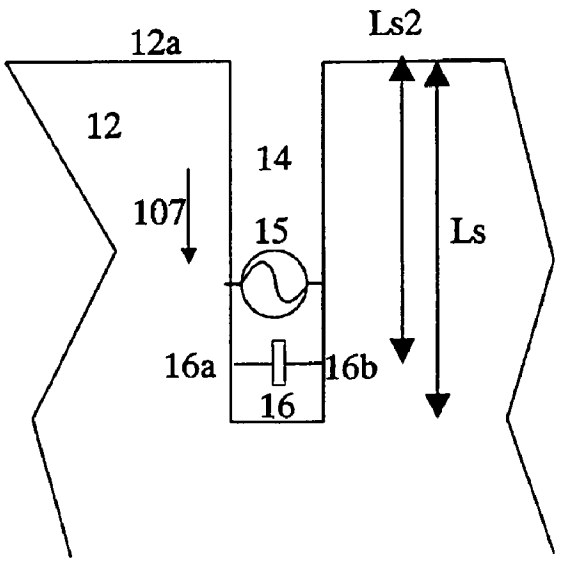
FIG. 24A is a schematic structural diagram of a ¼ wavelength slot antenna described in Japanese Laid-Open Patent Publication No. 2004-336328.
Figure 24B:
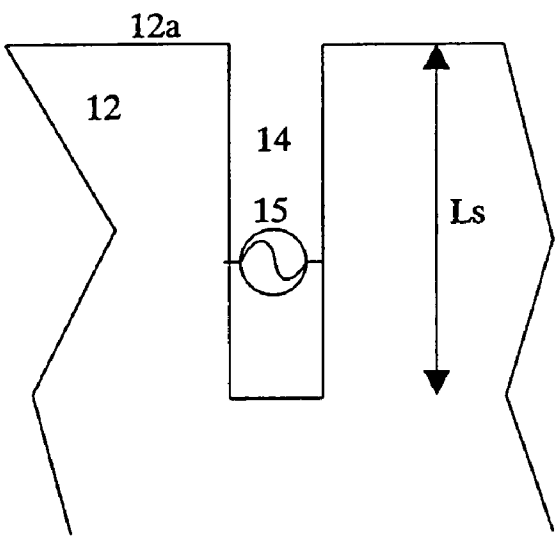
FIG. 24B is a schematic structural diagram during an operation of the slot antenna in a low-frequency band.
Figure 24C:
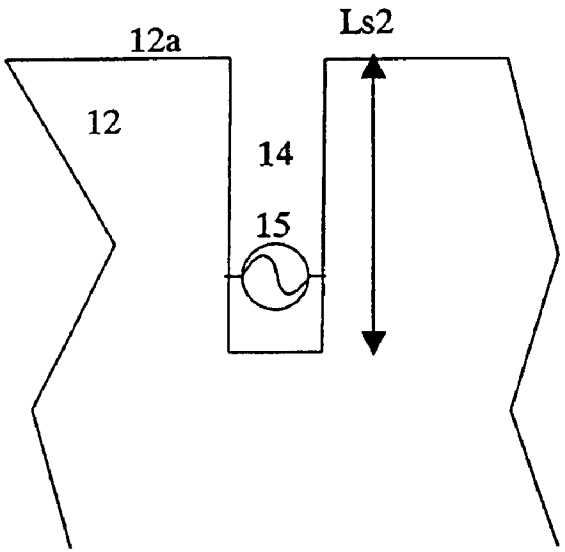
FIG. 24C is a schematic structural diagram during an operation of the slot antenna in a high-frequency band.
Figure 25:
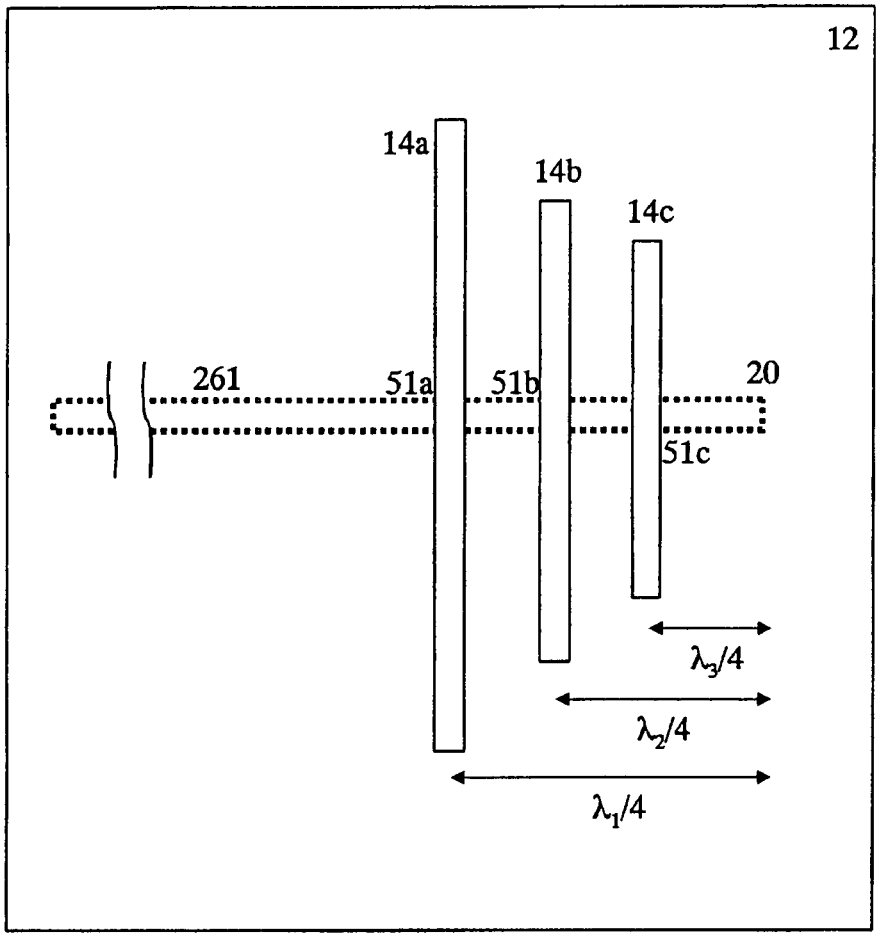
FIG. 25 is a schematic see-through view of a slot antenna structure described in Japanese Laid-Open Patent Publication No. 2004-23507 as seen through the rear face side.

In FIG. 22, (*a*) to (*d*) show angle dependences of radiation directivity within a plane which is parallel to the dielectric substrate of the slot antenna of Example 3, at the frequencies of: 2.6 GHz (FIG. 22(*a*)); 4 GHz (FIG. 22(*b*)); 6 GHz (FIG. 22(*c*)); and 9 GHz (FIG. 22(*d*)). In these figures, a direction corresponding to the angle of 270° is the direction of the slot open end as viewed from the deep end of the slot. At all frequencies within the operating band in which low-return intensity characteristics or −10 dB or less were obtained, the main beam was oriented in this direction, and substantially the same gain value (from 0 dB to 4 dB) was obtained.

Thus, the slot antenna of the present invention achieves not only ultrawideband return characteristics but also a similar tendency of radiation directivity across the ultrawideband.

Without an increase in the circuit area or production cost, the slot antenna of the present invention can expand its matching band. Thus, with a simple construction, the present invention realizes a multi-functional terminal device which could conventionally be realized only by incorporating a plurality of antennas. The slot antenna of the present invention can also contribute to the realization of a short-range wireless communication system, which exploits a much wider frequency band than conventionally. Since the operating band can be expanded without using a chip part, the slot antenna of the present invention is also useful as an antenna which is immune to variations during production. Since a much wider-band operation than that of a conventional wideband slot antenna can be realized under the same slot width condition, it is also possible to realize a downsized wideband slot antenna. The slot antenna of the present invention can be used as a small-sized antenna also in a system which requires ultrawideband frequency characteristics where digital signals are transmitted or received wirelessly.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A slot antenna comprising:

a dielectric substrate;

a ground conductor provided on a rear face side of the dielectric substrate, the ground conductor having a finite area;

a slot which recesses into the ground conductor, beginning from an open-end point on a side edge of the ground conductor; and a feed line for supplying a high-frequency signal to the slot, the feed line at least partially intersecting the slot, wherein, at a first point near the slot, the feed line branches into a group of branch lines including at least two branch lines, such that at least two branch lines in the group of branch lines are connected to each other at a second point near the slot to form at least one loop line in the feed line, the second point being different from the first point;

a maximum value of a loop length of each loop line is prescribed to be less than 1× effective wavelength at an upper limit frequency of an operating band of the slot antenna; and in the group of branch lines, any branch line that does not constitute a part of the loop line but terminates with a leading open-end point has a branch length which is less than a ¼ effective wavelength at the upper limit frequency of the operating band.

2. The slot antenna of claim 1, wherein each loop line intersects an edge of the slot, the slot being excitable two or more places where the edge of the slot is intersected by the at least one loop line, the two or more places being at respectively different distances from the open-end point of the slot.

3. The slot antenna of claim 1, wherein, a region of the feed line spanning a distance corresponding to a ¼ effective wavelength at a center frequency of the operating band from the leading open-end point is composed of a transmission line having a characteristic impedance higher than 50Ω; and along the distance corresponding to a ¼ effective wavelength at the center frequency of the operating band from the leading open-end point, the feed line at least partially intersects the slot.

* * * * *

UNITED STATES PATENT AND TRADEMARK OFFICE

CERTIFICATE OF CORRECTION

PATENT NO. : 7,397,439 B2
APPLICATION NO. : 11/723786
DATED : July 8, 2008
INVENTOR(S) : Hiroshi Kanno et al.

It is certified that error appears in the above-identified patent and that said Letters Patent is hereby corrected as shown below:

In Column 18, Line 23 (Claim 2), change “excitable two” to --excitable at two--.

Signed and Sealed this

Seventeenth Day of March, 2009

JOHN DOLL
*Acting Director of the United States Patent and Trademark Office*